US008374793B2

(12) United States Patent
Ekseth et al.

(10) Patent No.: US 8,374,793 B2
(45) **Date of Patent: *Feb. 12, 2013**

(54) REDUCING ERROR CONTRIBUTIONS TO GYROSCOPIC MEASUREMENTS FROM A WELLBORE SURVEY SYSTEM

(75) Inventors: Roger Ekseth, Sjetnemarka (NO); John Lionel Weston, Chedzoy (GB); Gary William Uttecht, Houston, TX (US)

(73) Assignee: Gyrodata, Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/243,989

(22) Filed: Sep. 23, 2011

(65) Prior Publication Data

US 2012/0095685 A1 Apr. 19, 2012

Related U.S. Application Data

(63) Continuation of application No. 12/363,465, filed on Jan. 30, 2009, now Pat. No. 8,065,087.

(51) Int. Cl.
*G01C 19/00* (2006.01)

(52) U.S. Cl. ..... 702/6; 702/150

(58) Field of Classification Search ..... 702/6, 150
See application file for complete search history.

(56) References Cited

U.S. PATENT DOCUMENTS

| | | | |
|---|---|---|---|
| 1,559,538 | A | 9/1926 | Mintrop |
| 3,143,892 | A | 8/1964 | Chapman |
| 3,490,149 | A | 1/1970 | Bowers |
| 3,741,500 | A | 6/1973 | Liden |
| 4,199,869 | A | 4/1980 | Van Steenwyk |
| 4,293,046 | A | 10/1981 | Van Steenwyk |
| 4,297,790 | A | 11/1981 | Van Steenwyk et al. |
| 4,433,491 | A | 2/1984 | Ott et al. |
| 4,461,088 | A | 7/1984 | Van Steenwyk |
| 4,471,533 | A | 9/1984 | Van Steenwyk |
| 4,522,062 | A | 6/1985 | Peters |
| 4,537,067 | A | 8/1985 | Sharp et al. |
| 4,545,242 | A | 10/1985 | Chan |
| 4,593,559 | A | 6/1986 | Brown et al. |
| 4,611,405 | A | 9/1986 | Van Steenwyk |
| 4,821,572 | A | 4/1989 | Hulsing |
| 4,909,336 | A | 3/1990 | Brown et al. |
| 4,987,684 | A | 1/1991 | Andreas et al. |
| 5,099,927 | A | 3/1992 | Gibson et al. |

(Continued)

FOREIGN PATENT DOCUMENTS

| | | |
|---|---|---|
| EP | 0 497 420 | 8/1992 |
| EP | 0 646 696 | 9/1994 |

(Continued)

OTHER PUBLICATIONS

*±150°/s Single Chip Yaw Rate Gyro with Signal Conditioning*, Analog Devices, ADXRS150, © 2003 Analog Devices, Inc.

(Continued)

*Primary Examiner* — Andrew Schechter
*Assistant Examiner* — L. Anderson
(74) *Attorney, Agent, or Firm* — Knobbe, Martens, Olson & Bear LLP

(57) ABSTRACT

A method reduces error contributions to gyroscopic measurements from a first gyroscopic sensor and a second gyroscopic sensor. The method includes receiving a first set of measurement signals and a second set of measurement signals indicative of at least one substantially perpendicular component and indicative of a substantially parallel component of the Earth's rotation. The method further includes receiving one or more measurement signals generated by a plurality of accelerometers and calculating a first and second mass unbalance offset error for the first gyroscopic sensor and the second gyroscopic sensor, respectively.

28 Claims, 12 Drawing Sheets

U.S. PATENT DOCUMENTS

| | | | |
|---|---|---|---|
| 5,319,561 | A | 6/1994 | Matsuzaki |
| 5,432,699 | A | 7/1995 | Hache et al. |
| 5,512,830 | A | 4/1996 | Kuckes |
| 5,522,260 | A | 6/1996 | Chappellat et al. |
| 5,585,726 | A | 12/1996 | Chau |
| 5,606,124 | A | 2/1997 | Doyle et al. |
| 5,635,638 | A | 6/1997 | Geen et al. |
| 5,635,640 | A | 6/1997 | Geen et al. |
| 5,657,547 | A | 8/1997 | Uttecht et al. |
| 5,806,195 | A | 9/1998 | Uttecht et al. |
| 5,812,068 | A | 9/1998 | Wisler et al. |
| 5,821,414 | A | 10/1998 | Noy et al. |
| 5,842,149 | A | 11/1998 | Harrell et al. |
| 5,869,760 | A | 2/1999 | Geen |
| 5,912,524 | A | 6/1999 | Ohnishi et al. |
| 5,946,094 | A | 8/1999 | Sahlgren et al. |
| 6,021,377 | A | 2/2000 | Dubinsky et al. |
| 6,023,325 | A | 2/2000 | Sahlgren et al. |
| 6,044,706 | A | 4/2000 | Roh |
| 6,089,089 | A | 7/2000 | Hsu |
| 6,122,961 | A | 9/2000 | Geen et al. |
| 6,134,961 | A | 10/2000 | Touge et al. |
| 6,145,378 | A | 11/2000 | MacRobbie et al. |
| 6,173,773 | B1 | 1/2001 | Almaguer et al. |
| 6,173,793 | B1 | 1/2001 | Thompson et al. |
| 6,192,748 | B1 | 2/2001 | Miller |
| 6,206,108 | B1 | 3/2001 | MacDonald et al. |
| 6,257,356 | B1 | 7/2001 | Wassell |
| 6,267,185 | B1 | 7/2001 | Mougel et al. |
| 6,272,434 | B1 | 8/2001 | Wisler et al. |
| 6,281,618 | B1 | 8/2001 | Ishitoko et al. |
| 6,315,062 | B1 | 11/2001 | Alft et al. |
| 6,347,282 | B2 | 2/2002 | Estes et al. |
| 6,360,601 | B1 | 3/2002 | Challoner et al. |
| 6,381,858 | B1 | 5/2002 | Shirasaka |
| 6,389,187 | B1 | 5/2002 | Greenaway et al. |
| 6,431,270 | B1 | 8/2002 | Angle |
| 6,453,239 | B1 | 9/2002 | Shirasaka et al. |
| 6,484,818 | B2 | 11/2002 | Alft et al. |
| 6,529,834 | B1 | 3/2003 | Estes et al. |
| 6,655,460 | B2 | 12/2003 | Bailey et al. |
| 6,659,201 | B2 | 12/2003 | Head et al. |
| 6,714,870 | B1 | 3/2004 | Weston et al. |
| 6,837,332 | B1 | 1/2005 | Rodney |
| 6,845,665 | B2 | 1/2005 | Geen |
| 6,848,304 | B2 | 2/2005 | Geen |
| 6,859,751 | B2 | 2/2005 | Cardarelli |
| 6,895,678 | B2 | 5/2005 | Ash et al. |
| 6,957,580 | B2 | 10/2005 | Ekseth et al. |
| 7,028,409 | B2 | 4/2006 | Engebretson et al. |
| 7,117,605 | B2 | 10/2006 | Ekseth et al. |
| 7,225,550 | B2 | 6/2007 | Ekseth et al. |
| 7,350,410 | B2 | 4/2008 | Ekseth et al. |
| 7,584,788 | B2 | 9/2009 | Baron et al. |
| 2002/0032529 | A1 | 3/2002 | Duhon |
| 2002/0046605 | A1 | 4/2002 | Geen et al. |
| 2002/0056201 | A1 | 5/2002 | Dallas et al. |
| 2002/0112887 | A1 | 8/2002 | Harrison |
| 2004/0073369 | A1 | 4/2004 | McElhinney |
| 2005/0022404 | A1 | 2/2005 | Ash et al. |
| 2005/0109097 | A1 | 5/2005 | Bogath et al. |
| 2005/0150689 | A1 | 7/2005 | Jogi et al. |
| 2005/0183502 | A1 | 8/2005 | Rodney |
| 2005/0224257 | A1 | 10/2005 | Ekseth et al. |
| 2006/0070770 | A1 | 4/2006 | Marsh |
| 2006/0253253 | A1 | 11/2006 | Reynolds et al. |
| 2007/0235226 | A1 | 10/2007 | Wright et al. |
| 2009/0119937 | A1 | 5/2009 | Watson |
| 2010/0100329 | A1 | 4/2010 | Ekseth et al. |

FOREIGN PATENT DOCUMENTS

| | | |
|---|---|---|
| EP | 2 045 440 | 4/2009 |
| GB | 2172324 | 9/1986 |
| GB | 2177738 | 1/1987 |
| SU | 901485 | 1/1982 |
| WO | WO 02/103158 | 12/2002 |
| WO | WO 2005/008029 | 1/2005 |
| WO | WO 2005/073509 | 8/2005 |
| WO | WO 2005/100916 | 10/2005 |

OTHER PUBLICATIONS

*±300°/s Single Chip Yaw Rate Gyro with Signal Conditioning*, Analog Devices, ADXRS300.. © 2004 Analog Devices, Inc.

Geen, J., et al., *New iMEMS® Angular-Rate-Sensing Gyroscope*, Analog Dialogue, 2003, vol. 37, No. 3, pp. 1-4.

International Search Report and Written Opinion for PCT/US2010/021538, mailed Aug. 12, 2010 in 15 pages.

International Search Report and Written Opinion for PCT/US2010/022653, mailed Dec. 8, 2010 in 12 pages.

International Search Report for Application No. PCT/US2004/021899, mailed Dec. 11, 2004 in 2 pages.

"Reflex Maxibor II, Borehole Survey System". Reflex Product Information, Printed from www.reflex.se on Feb. 7, 2007 in 8 pages.

Teegarden, Darrell, et al., *How to Model and Simulate Microgyroscope Systems*, IEEE Spectrum, Jul. 1998, vol. 35, No. 7, pp. 66-75.

Torkildsen, et al., "Prediction of Well Bore Position Accuracy, When Surveyed with Gyroscopic Tools," Industry Steering Committee on Wellbore Survey Accuracy, ISCWSA, dated Jan. 29, 2004 in 63 pages.

Uttecht, G.W., et al., "Survey Accuracy is Improved by a New, Small OD Gyro "*World Oil*, Mar. 1983.

Yazdi, N., et al., *Micromachined Inertial Sensors*, Proc. of the IEEE, Aug. 1998, vol. 86, No. 8, pp. 1640-1659.

US 6,151,553, 11/2000, Estes et al. (withdrawn)

REDUCING ERROR CONTRIBUTIONS TO GYROSCOPIC MEASUREMENTS FROM A WELLBORE SURVEY SYSTEM

CROSS-REFERENCE TO RELATED APPLICATIONS

This application is a continuation of U.S. patent application Ser. No. 12/363,465, filed Jan. 30, 2009, the disclosure of which is incorporated in its entirety by reference herein.

BACKGROUND OF THE INVENTION

1. Field of the Invention

The present application relates generally to systems and method for reducing error contributions to gyroscopic measurements from a wellbore survey system and/or determining the position or orientation of the survey system relative to the Earth.

2. Description of the Related Art

Many wellbore gyroscopic survey systems that are currently in service are based on angular rate measurements taken about two axes only, denoted the x and y axes, that are both substantially perpendicular to the direction along the wellbore (referred to as the "along-hole axis") and substantially perpendicular to each other. In stationary gyroscopic survey systems, these measurements are used to determine the direction of the survey tool in the wellbore with respect to true north, the tool azimuth angle, using measurements of the horizontal components of Earth's rotation sensed about a measurement axis of the survey tool in a process known as gyro compassing or north finding. In many such systems, the gyroscopes ("gyros"), and other inertial sensors (e.g., accelerometers) used by the survey system, are attached rigidly or via anti-vibration mounts to the housing of the survey tool in what is referred to as a strapdown mechanization.

In many such survey tools, it is common practice to take two sets of gyroscopic sensor measurements of the Earth's angular rotational rate in two different directions substantially perpendicular to the along-hole direction, typically by rotating the xy-gyros through 180 degrees about the along-hole axis of the survey tool between each set of readings. This procedure is referred to as "indexing" the gyro, and it yields substantial benefits in terms of both the speed with which tool direction with respect to true north can be determined and the accuracy to which that direction can be obtained. The latter benefit derives from the fact that the effect of gyro measurement biases can be substantially reduced, or removed completely, through indexing the gyro.

The indexing of the xy-gyro can be achieved by mounting this sensor on a rotatable platform that can be turned between the two index positions that are usually 180 degrees apart. Such a configuration is disclosed in U.S. Pat. Nos. 5,657,547 and 5,806,195, each of which is incorporated in its entirety by reference herein. Upon the turning of the xy-gyro, the components of Earth's rotation sensed by the xy-gyro change sign between the two index positions at which the readings are taken, but the signs of any residual biases do not change. Hence, by summing the two measurements from the xy-gyro and dividing the result by two, an estimate of the residual bias is obtained. Similarly, by calculating the difference between the two measurements and dividing the result by two, an improved estimate of the true applied rotation rate can be extracted that is not corrupted by any fixed bias in the gyro measurements. Given knowledge of the inclination and tool face angle of the tool, derived from accelerometer measurements, together with knowledge of the true rotation rate of the Earth and the latitude at which the measurements are being taken, an estimate of the azimuth angle of the survey tool may be obtained. While azimuth can be determined using a strapdown system, the process takes considerably longer to implement without the facility to index the gyro.

Indexed gyro compassing may be achieved with a single gyro by mounting the gyro and its indexing mechanism on stable platform within the survey tool so as to maintain the index axis coincident with the local vertical. In theory, such a system could be used to determine the direction of the survey tool with respect to true north, irrespective of tool orientation. However, the mechanical complexity and consequent size of such a system preclude it as a viable option for down-hole application.

SUMMARY

In certain embodiments, a method reduces error contributions to gyroscopic measurements. The method comprises providing a survey system within a portion of a wellbore. The survey system comprises a first gyroscopic sensor adapted to generate measurement signals indicative of at least one component of the Earth's rotation substantially perpendicular to the portion of the wellbore. The survey system further comprises a second gyroscopic sensor adapted to generate measurement signals indicative of a component of the Earth's rotation substantially parallel to the portion of the wellbore. The method further comprises generating a first measurement signal indicative of the at least one component of the Earth's rotation substantially perpendicular to the portion of the wellbore using the first gyroscopic sensor while the first gyroscopic sensor is in a first orientation relative to the wellbore. The method further comprises generating a second measurement signal indicative of the at least one component of the Earth's rotation substantially perpendicular to the portion of the wellbore using the first gyroscopic sensor while the first gyroscopic sensor is in a second orientation relative to the wellbore. The second orientation is different from the first orientation. The method further comprises generating a third measurement signal indicative of the component of the Earth's rotation substantially parallel to the portion of the wellbore using the second gyroscopic sensor while the second gyroscopic sensor is in a first orientation relative to the wellbore. The method further comprises generating a fourth measurement signal indicative of the component of the Earth's rotation substantially parallel to the portion of the wellbore using the second gyroscopic sensor while the second gyroscopic sensor is in a second orientation relative to the wellbore. The second orientation is different from the first orientation. The method further comprises calculating information regarding at least one error contribution to measurement signals from the survey system using the first measurement signal, the second measurement signal, the third measurement signal, and the fourth measurement signal. The at least one error contribution comprises at least one of a mass unbalance offset error and a quadrature bias error of at least one of the first gyroscopic sensor and the second gyroscopic sensor.

In certain embodiments, a method reduces error contributions to gyroscopic measurements. The method comprises providing a survey system within a portion of a wellbore. The survey system comprises a first gyroscopic sensor adapted to be indexed and to generate measurement signals indicative of at least one component of the Earth's rotation substantially perpendicular to the portion of the wellbore. The survey system further comprises a second gyroscopic sensor adapted to be indexed and to generate measurement signals indicative of a component of the Earth's rotation substantially parallel to the portion of the wellbore. The method further comprises using the first gyroscopic sensor to generate at least one first measurement signal indicative of the at least one component of the Earth's rotation substantially perpendicular to the portion of the wellbore. The method further comprises indexing the first gyroscopic sensor. The method further comprises using the first gyroscopic sensor to generate at least one second measurement signal indicative of the at least one component of the Earth's rotation substantially perpendicular to the portion of the wellbore. The method further comprises using the second gyroscopic sensor to generate at least one first measurement signal indicative of the component of the Earth's rotation substantially parallel to the portion of the wellbore. The method further comprises indexing the second gyroscopic sensor. The method further comprises using the second gyroscopic sensor to generate at least one second measurement signal indicative of the component of the Earth's rotation substantially parallel to the portion of the wellbore. The method further comprises calculating information regarding at least one error contribution to measurement signals from the survey system using the at least one first measurement signal from the first gyroscopic sensor and the at least one second measurement signal from the first gyroscopic sensor and the at least one first measurement signal from the second gyroscopic sensor and the at least one second measurement signal from the second gyroscopic sensor. The at least one error contribution comprises at least one of a mass unbalance offset error and a quadrature bias error of at least one of the first gyroscopic sensor and the second gyroscopic sensor.

In certain embodiments, a computer system reduces error contributions to gyroscopic measurements made using a survey system within a portion of a wellbore. The survey system comprises a first gyroscopic sensor and a second gyroscopic sensor. The computer system comprises means for controlling an orientation of the first gyroscopic sensor relative to the portion of a wellbore. The first gyroscopic sensor is adapted to generate measurement signals indicative of at least one component of the Earth's rotation substantially perpendicular to the portion of the wellbore. The computer system further comprises means for controlling an orientation of the second gyroscopic sensor relative to the portion of the wellbore. The second gyroscopic sensor is adapted to generate measurement signals indicative of a component of the Earth's rotation substantially parallel to the portion of the wellbore. The computer system further comprises means for receiving at least one measurement signal from the first gyroscopic sensor while the first gyroscopic sensor has a first orientation relative to the portion of the wellbore and for receiving at least one measurement signal from the first gyroscopic sensor while the first gyroscopic sensor has a second orientation relative to the portion of the wellbore. The second orientation is different from the first orientation. The computer system further comprises means for receiving at least one measurement signal from the second gyroscopic sensor while the second gyroscopic sensor has a first orientation relative to the portion of the wellbore and for receiving at least one measurement signal from the second gyroscopic sensor while the second gyroscopic sensor has a second orientation relative to the portion of the wellbore. The second orientation is different from the first orientation. The computer system further comprises means for calculating information regarding at least one error contribution to measurement signals from the survey system using the measurement signals received from the first gyroscopic sensor in its first orientation and its second orientation and the measurement signals received from the second gyroscopic sensor in its first orientation and its second orientation. The at least one error contribution comprises at least one of a mass unbalance offset error and a quadrature bias error of at least one of the first gyroscopic sensor and the second gyroscopic sensor.

In certain embodiments, a computer-readable medium has instructions stored thereon which cause a general-purpose computer to perform a method for reducing error contributions to gyroscopic measurements made using a survey system within a portion of a wellbore. The survey system comprises a first gyroscopic sensor and a second gyroscopic sensor. The method comprises controlling an orientation of the first gyroscopic sensor relative to the portion of the wellbore. The first gyroscopic sensor is adapted to generate measurement signals indicative of at least one component of the Earth's rotation substantially perpendicular to the portion of the wellbore. The method further comprises controlling an orientation of the second gyroscopic sensor relative to the portion of the wellbore. The second gyroscopic sensor is adapted to generate measurement signals indicative of a component of the Earth's rotation substantially parallel to the portion of the wellbore. The method further comprises receiving at least one measurement signal from the first gyroscopic sensor while the first gyroscopic sensor has a first orientation relative to the survey system. The method further comprises receiving at least one measurement signal from the first gyroscopic sensor while the first gyroscopic sensor has a second orientation relative to the portion of the wellbore. The second orientation is different from the first orientation. The method further comprises receiving at least one measurement signal from the second gyroscopic sensor while the second gyroscopic sensor has a first orientation relative to the portion of the wellbore. The method further comprises receiving at least one measurement signal from the second gyroscopic sensor while the second gyroscopic sensor has a second orientation relative to the portion of the wellbore. The second orientation is different from the first orientation. The method further comprises calculating information regarding at least one error contribution to measurement signals from the survey system using the measurement signals received from the first gyroscopic sensor in its first orientation and its second orientation and the measurement signals received from the second gyroscopic sensor in its first orientation and its second orientation. The at least one error contribution comprises at least one of a mass unbalance offset error and a quadrature bias error of at least one of the first gyroscopic sensor and the second gyroscopic sensor.

DETAILED DESCRIPTION

There is an increasing demand for high accuracy surveys of highly deviated and extended reach wellbores. For example, modern survey systems may operate at any attitude, e.g., at 90 degrees inclination and beyond in horizontal extended reach wells, and high accuracy surveys in such wellbores are desirable.

While the two-axis strapdown system outlined above provides accurate estimates of wellbore azimuth in a near vertical well, this accuracy degrades as inclination increases, with the azimuth becoming indeterminate due to a singularity in the calculation at 90 degrees inclination. To overcome this limitation, an additional rotation rate measurement about the along-hole or longitudinal (z) axis of the survey tool can be performed.

While down-hole gyro survey systems incorporating a strapdown gyro mounted to provide the necessary z-axis measurement already exist, there is a need for a sensor configuration that will allow the sensor system to establish the direction of the wellbore with respect to true north accurately and within a short period of time (e.g., within 1 or 2 minutes). Certain embodiments described herein address this particular need, along with the identification of residual gyro errors as a part of the gyrocompass indexing process.

Figure 1:
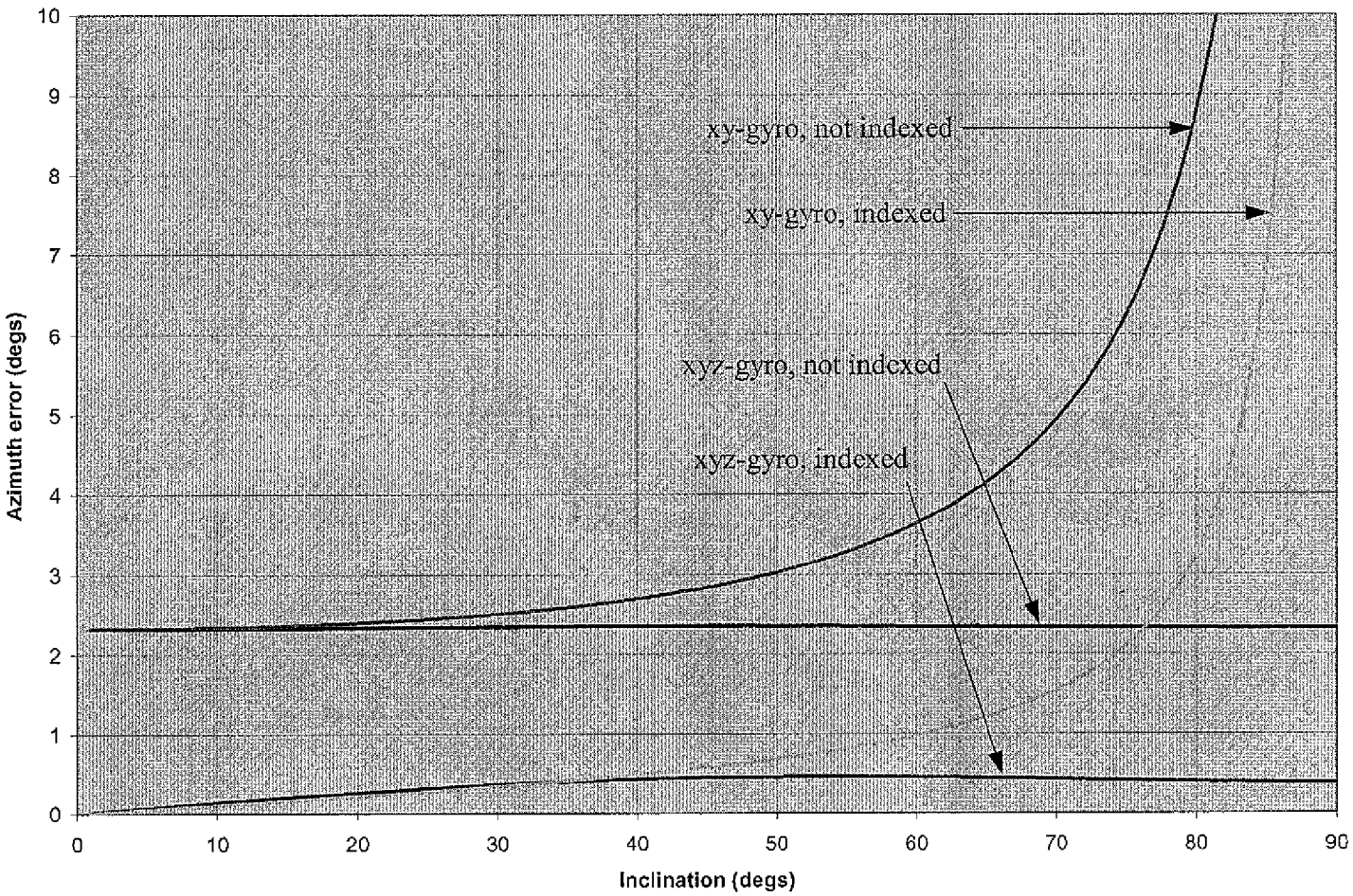
FIG. 1 is a plot of azimuth error as a function of inclination for both xy-gyro and xyz-gyro survey systems.

FIG. 1 is a plot of azimuth error as a function of inclination for both xy-gyro and xyz-gyro survey systems, with and without indexing of the gyro measurements, thereby schematically illustrates the potential benefits of moving from an indexed two-axis (xy-gyro) system to an indexed xyz-gyro system. The azimuthal errors shown in FIG. 1 are representative of a tuned-rotor gyro-based system in which a residual fixed bias, a mass unbalance offset, and a quadrature acceleration-dependent error are present. FIG. 1 shows clearly the effect of the singularity as the inclination of the survey tool approaches 90 degrees in a two-axis system. The effect of the singularity is removed by introducing the additional measurement along the z-axis. It also shows the benefit of indexing the gyro(s) to remove residual biases in the gyro measurements. However, FIG. 1 does not show the corresponding benefit of timing that is achieved (e.g., more rapid north finding) by indexing the gyros.

Certain embodiments described herein utilize wellbore gyro survey systems that allow gyro compassing/north finding to be performed irrespective of the attitude or orientation of the survey tool, and are able to perform this function both rapidly and accurately. Certain such embodiments advantageously index both the xy-gyro and the z-gyro. For example, certain such embodiments allow a rapid gyro compassing alignment of the survey system to be carried out when the tool is horizontal, thereby avoiding the singularity problem that arises when using a xy-gyro system only. U.S. Pat. Nos. 6,347,282 and 6,529,834, each of which is incorporated in its entirety by reference herein, disclose a method and apparatus for indexing a second gyro for the purpose of identifying and removing systematic biases in the measurements provided by the second gyro. In contrast, certain embodiments described herein go beyond merely determining the systematic biases in the gyros by identifying and removing the effects of additional gyro measurement error terms (e.g., mass unbalance error and quadrature error) that contribute significantly to survey inaccuracy if they are allowed to remain uncorrected.

Certain embodiments described herein provide a number of options in terms of the relative orientation of the sensitive axes of the gyros, the choice of index rotation angles that may be used, and the application of different gyro technologies. These different options arise as result of performance considerations and spatial limitations which determine how a particular survey system may be mounted within a narrow tube, as is typically required for down-hole applications and underground surveying generally.

Figure 2:
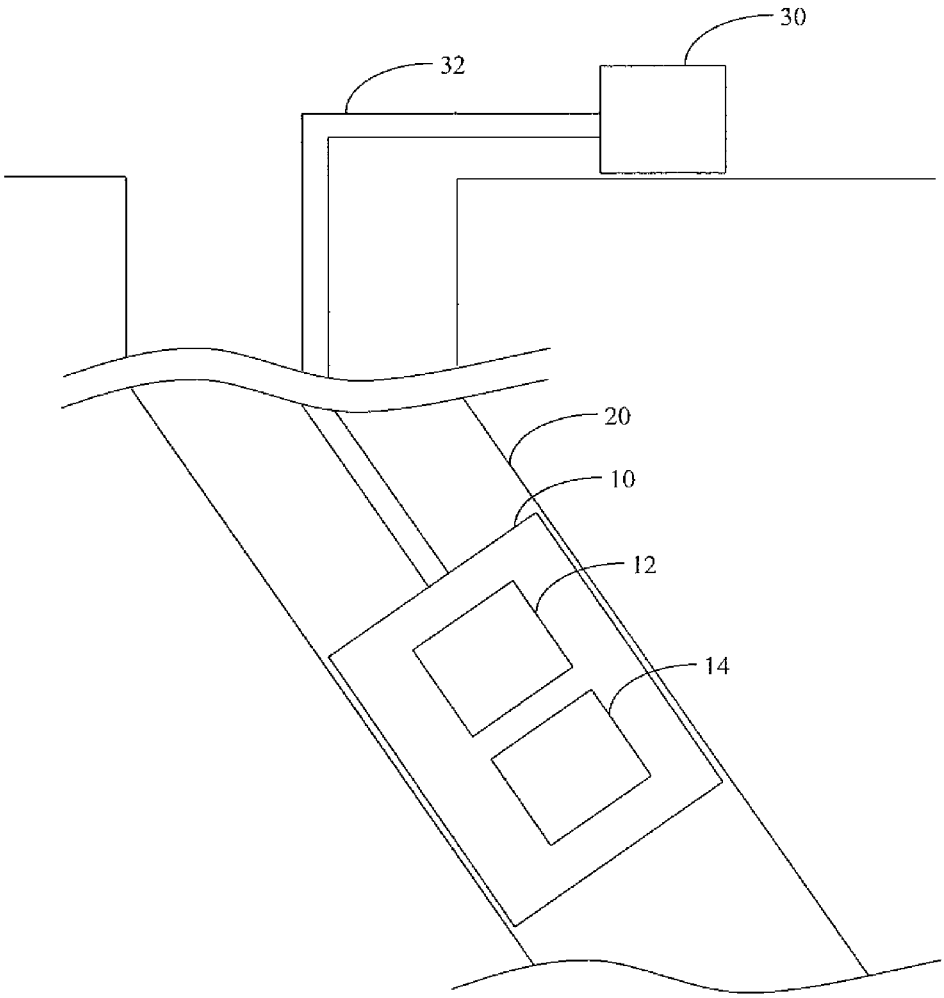
FIG. 2 schematically illustrates an example survey system within a portion of a wellbore in accordance with certain embodiments described herein.

FIG. 2 schematically illustrates an example survey system 10 within a portion of a wellbore 20 in accordance with certain embodiments described herein. In certain embodiments, the survey system 10 is used in logging or drilling applications. For example, the survey system 10 of certain embodiments comprises a measurement while drilling (MWD) instrumentation pack which is part of a downhole portion of a drill string within the wellbore 20. The survey system 10 comprises a first gyroscopic sensor 12 and a second gyroscopic sensor 14. The first gyroscopic sensor 12 is adapted to generate measurement signals indicative of at least one component of the Earth's rotation substantially perpendicular to the portion of the wellbore 20. The second gyroscopic sensor 14 is adapted to generate measurement signals indicative of a component of the Earth's rotation substantially parallel to the portion of the wellbore 20. In certain embodiments, one or both of the first gyroscopic sensor 12 and the second gyroscopic sensor 14 comprises one or more gyros selected from the group consisting of: a spinning mass gyroscope such as a single-axis rate integrating gyroscope or a dual-axis dynamically tuned gyroscope, an optical gyroscope such as a ring laser gyroscope (RLG) or a fiber-optic gyroscope (FOG), a Coriolis vibratory gyroscope such as a tuning fork gyro or a hemispherical resonator gyro (HRG), a microelectromechanical system (MEMS) gyro. In certain embodiments, one or both of the first gyroscopic sensor 12 and the second gyroscopic sensor comprises any other sensor capable of providing precision measurements of rotational motion.

As described more fully below, in certain embodiments, the survey system 10 comprises an indexing mechanism which allows the direction of the measurement or input axes of the first gyroscopic sensor 12 and the second gyroscopic sensor 14 to be changed between two or more measurement positions or orientations. In certain embodiments, the survey system 10 further comprises one or more acceleration sensors (e.g., single-axis or multiple-axis accelerometers), one or more magnetic sensors (e.g., single-axis or multiple axis magnetometers), and/or one or more gamma ray sensors to provide further information regarding the position or orientation of the survey system 10.

In certain embodiments, a computer system 30 is coupled to the survey system 10 so as to provide control signals to the survey system 10 to control an orientation of the first gyroscopic sensor 12 relative to the portion of the wellbore 20 and to control an orientation of the second gyroscopic sensor 14 relative to the portion of the wellbore 20. In addition, the computer system 30 is configured to receive measurement signals from the first gyroscopic sensor 12 and from the second gyroscopic sensor 14, and to calculate information regarding at least one error contribution to the measurement signals. In certain embodiments, as schematically illustrated by FIG. 2, the computer system 30 is at the surface and is communicatively coupled to the survey system 10 (e.g., by an elongate portion 32 such as a wire or cable) such that signals are transmitted between the survey system 10 and the computer system 30. In certain other embodiments, at least a portion of the computer system 30 is located in the survey system 10 within the wellbore 20.

In certain embodiments, the computer system 30 comprises a microprocessor adapted to perform the method described herein for reducing error contributions to gyroscopic measurements made using the survey system 10. In certain embodiments, the computer system 30 is further adapted to determine the inclination and highside/toolface angle or the trajectory of the survey system 10 within the wellbore 20. In certain embodiments, the computer system 30 further comprises a memory subsystem adapted to store at least a portion of the data obtained from the sensors of the survey system 10. The computer system 30 can comprise hardware, software, or a combination of both hardware and software. In certain embodiments, the computer system 30 comprises a standard personal computer. In certain embodiments, the computer system 30 comprises appropriate interfaces (e.g., modems) to transmit control signals to the survey system 10 and to receive measurement signals from the survey system 10. The computer system 30 can comprise standard communication components (e.g., keyboard, mouse, toggle switches) for receiving user input, and can comprise standard communication components (e.g., image display screen, alphanumeric meters, printers) for displaying and/or recording operation parameters, survey system orientation and/or location coordinates, or other information provided by or derived from information from the survey system 10. In certain embodiments, the computer system 30 is configured to read a computer-readable medium (e.g., read-only memory, dynamic random-access memory, flash memory, hard disk drive, compact disk, digital video disk) which has instructions stored thereon which cause the computer system 30 to perform a method for reducing error contributions in accordance with certain embodiments described herein.

In certain embodiments, the computer system 30 is adapted to perform a post-processing analysis of the data obtained from the various sensors of the survey system 10. In certain such post-processing embodiments, data is obtained and saved from the various sensors as the survey system 10 travels within the wellbore 20, and the saved data are later analyzed to determine information regarding the wellbore 20. The saved data obtained from the various sensors advantageously may include time reference information (e.g., time tagging). In certain other embodiments, the computer system 30 provides a real-time processing analysis of the signals or data obtained from the various sensors of the survey system 10. In certain such real-time processing embodiments, data obtained from the various sensors are analyzed while the survey system 10 travels within the wellbore 20. In certain embodiments, at least a portion of the data obtained from the various sensors is saved in memory for analysis by the computer system 30, and the computer system 30 comprises sufficient data processing and data storage capacity to perform the real-time analysis.

Figure 3:
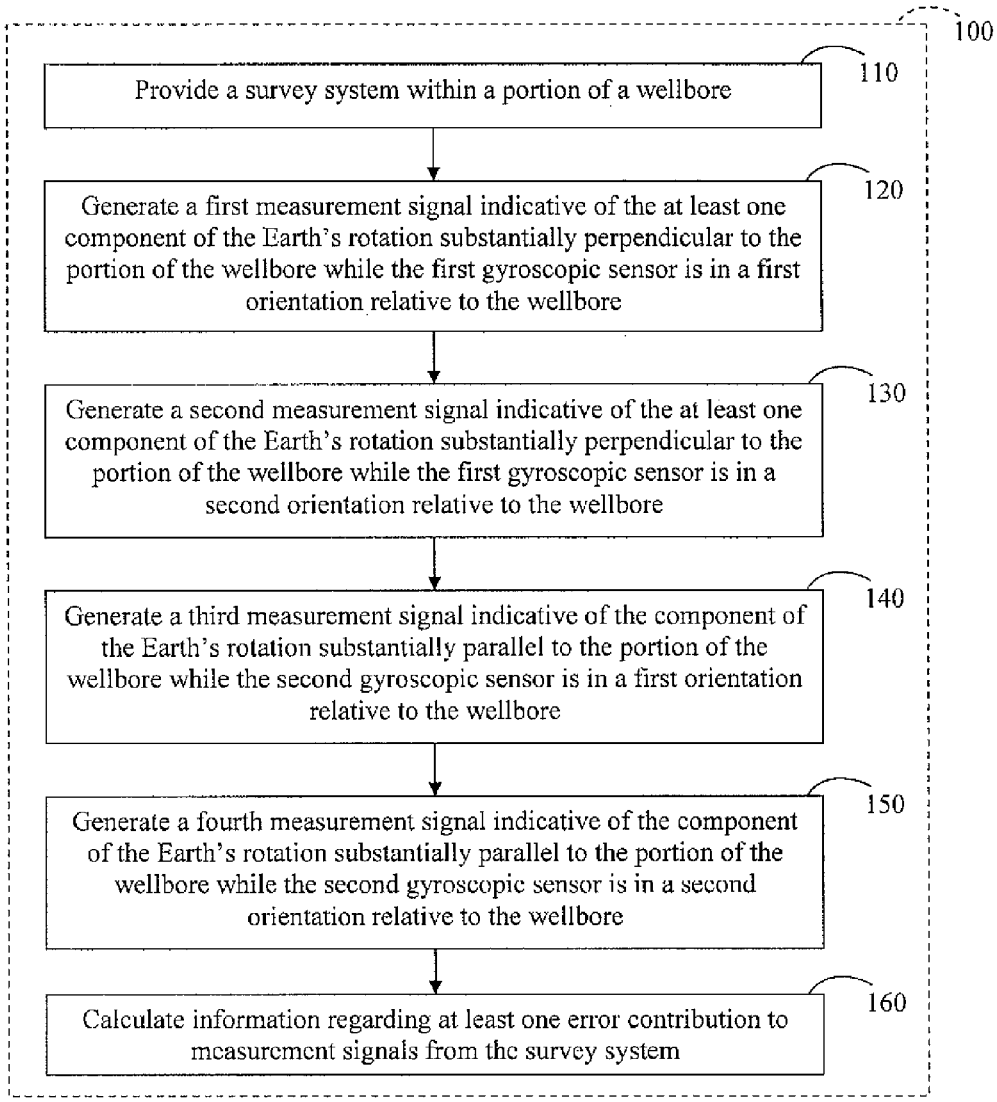
FIG. 3 is a flow diagram of an example method for reducing error contributions to gyroscopic measurements in accordance with certain embodiments described herein.

FIG. 3 is a flow diagram of an example method 100 for reducing error contributions to gyroscopic measurements in accordance with certain embodiments described herein. The method 100 comprises providing the survey system 10 within the portion of the wellbore 20 in an operational block 110. The survey system 10 comprises a first gyroscopic sensor 12 adapted to generate measurement signals indicative of at least one component of the Earth's rotation substantially perpendicular to the portion of the wellbore 20. For example, in certain embodiments, the portion of the wellbore 20 in which the survey system 10 is positioned extends along a z-direction, and the first gyroscopic sensor 12 generates measurement signals indicative of a component of the Earth's rotation in an x-direction substantially perpendicular to the z-direction. In certain such embodiments, the first gyroscopic sensor 12 further generates measurement signals indicative of a component of the Earth's rotation in a y-direction substantially perpendicular to both the x-direction and the z-direction. The survey system 10 further comprises a second gyroscopic sensor 14 adapted to generate measurement signals indicative of a component of the Earth's rotation substantially parallel to the portion of the wellbore 20. For example, in certain embodiments, the second gyroscopic sensor 14 generates measurement signals indicative of a component of the Earth's rotation in the z-direction.

In certain embodiments, the first gyroscopic sensor 12 comprises at least one single-axis gyroscope (e.g., a single-axis gyro with an input axis in the x-direction and a single-axis gyro with an input axis in the y-direction) or at least one dual-axis gyroscope (e.g., a dual-axis gyro with at least one of the input axes in either the x-direction or the y-direction). In certain embodiments, the second gyroscopic sensor 14 comprises at least one single-axis gyroscope (e.g., a single-axis gyro with an input axis in the z-direction) or at least one dual-axis gyroscope (e.g., a dual-axis gyro with at least one of the input axes in the z-direction). In certain embodiments, the survey system 10 comprises three single-axis gyros or two dual-axis gyros, which provide three axes of angular rotation rate measurement. In certain embodiments, the first gyroscopic sensor 12 and the second gyroscopic sensor 14 are both portions of a single gyroscopic sensor having input axes along the x-, y-, and z-directions. In certain embodiments, the survey system 10 comprises redundant gyroscopic sensors and at least one of the first gyroscopic sensor 12 and the second gyroscopic sensor 14 comprises a plurality of gyroscopic sensors with the same input axes. In certain such embodiments, the measurements along common input axes from these gyroscopic sensors and/or repeated measurements are advantageously averaged together to provide more reliable measurements, possible quality control checks, and/or a built-in test facility.

Figure 4A:
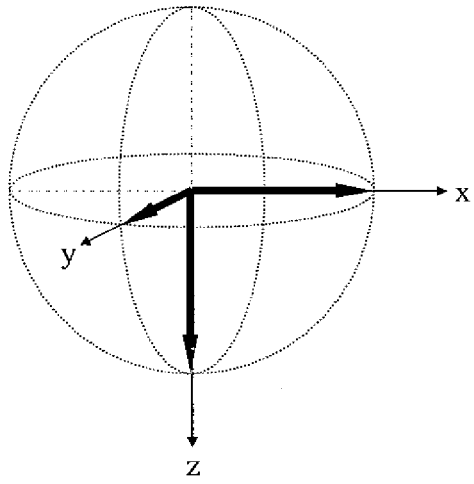
FIGS. 4A-4C schematically illustrate various orthogonalities among the x, y, and z axes of the first gyroscopic sensor and the second gyroscopic sensor.
Figure 4B:
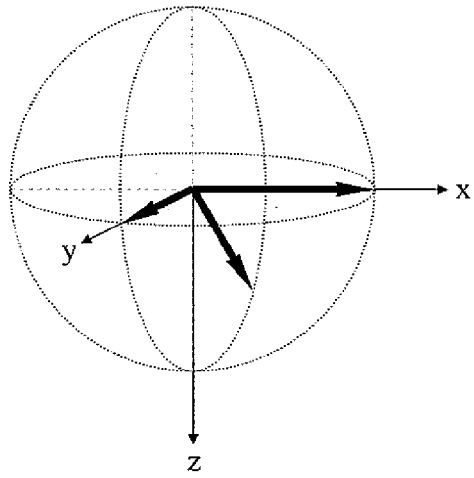
Figure 4C:
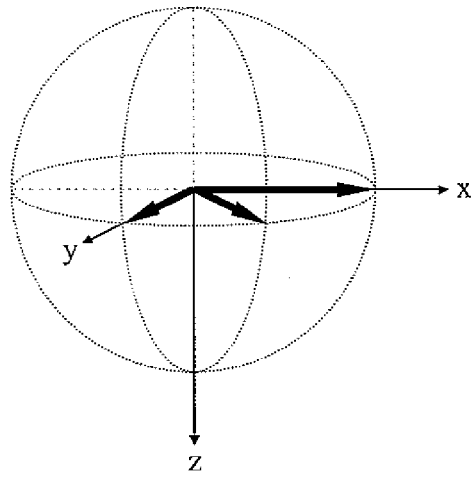

FIGS. 4A-4C schematically illustrate various orthogonalities among the x, y, and z axes of the first gyroscopic sensor 12 and the second gyroscopic sensor 14. The indexing mechanism of the survey system 10 allows the direction of the measurement or input axes of the first gyroscopic sensor 12 and the second gyroscopic sensor 14 to be changed between two or more measurement positions. For example, in certain embodiments the first gyroscopic sensor 12 comprises at least one multiple-axis xy-gyro (or at least two single-axis gyros) and the second gyroscopic sensor 14 comprises at least one single-axis z-gyro. As indicated in FIG. 4A, the first gyroscopic sensor 12 and the second gyroscopic sensor 14 are deployed with their respective input axes mutually orthogonal. The indexing mechanism is configured to rotate the xy-gyro(s) about the z-axis of the survey system 10 and to rotate the z-gyro about an axis that is perpendicular to the z-axis of the survey system 10, so that the gyros are rotated about axes that are perpendicular to one another. While the three measurement axes can be mutually orthogonal, as schematically illustrated by FIG. 4A, this condition is not essential. Skewed or non-orthogonal gyro mounting arrangements may be used in certain embodiments where, for example, a reduced space envelope may be achieved with such a configuration. An example is schematically illustrated by FIG. 4B in which the x and y axes are orthogonal to one another, but the third measurement axis is non-orthogonal to the x-y plane. Measurements of the angular rotation rate are advantageously made about three separate non-co-planar axes (see, e.g., FIGS. 4A and 4B). The mounting arrangement shown in FIG. 4C in which the sensor axes lie in a single plane is not acceptable.

Figure 5:
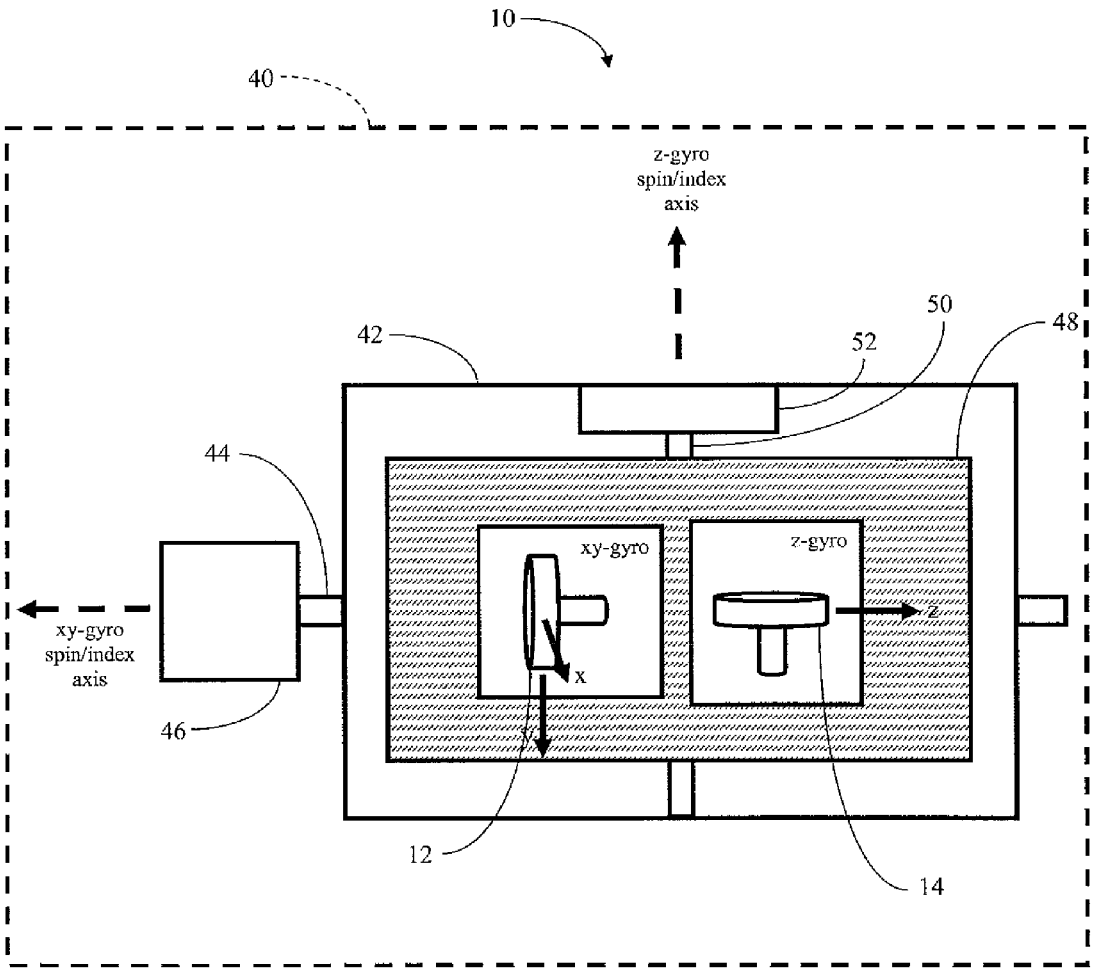
FIG. 5 schematically illustrates an example configuration of the survey system with a dual-axis gimbal in accordance with certain embodiments described herein.

FIG. 5 schematically illustrates an example configuration of the survey system 10 in accordance with certain embodiments described herein. The first gyroscopic sensor 12 comprises an xy-gyro and the second gyroscopic sensor 14 comprises a z-gyro. The example configuration schematically illustrated in FIG. 5 (as well as those of FIGS. 6 and 7) illustrate a survey system 10 containing two dual-axis gyros. The measurement axes of the first gyroscopic sensor 12 are mutually orthogonal to one another and a measurement axis of the second gyroscopic sensor 14 is orthogonal to both measurement axes of the first gyroscopic sensor 12. For example, the x- and y-axes are substantially perpendicular to the portion of the wellbore 20 in which the survey system 10 is positioned, and the z-axis is substantially parallel to the portion of the wellbore 20 in which the survey system 10 is positioned. Thus, the configuration of FIG. 5 is compatible with that of FIG. 4A.

The survey system 10 illustrated by FIG. 5 utilizes an indexing mechanism 40 comprising a concentric dual-gimbal arrangement to provide two orthogonal axes of rotation for indexing the first gyroscopic sensor 12 and the second gyroscopic sensor 14, thereby allowing these two gyroscopic sensors to be indexed or rotated about perpendicular axes. The indexing mechanism 40 comprises an outer gimbal 42, an outer gimbal drive shaft 44, and an outer gimbal drive motor 46. The indexing mechanism 40 further comprises an inner gimbal 48, an inner gimbal drive shaft 50, and an inner gimbal drive motor 52. The outer gimbal drive motor 46 is configured to rotate or index the outer gimbal 42 via the outer gimbal drive shaft 44. The inner gimbal drive motor 52 is configured to rotate or index the inner gimbal 48 via the inner gimbal drive shaft 50.

In certain embodiments in which conventional spinning wheel gyros are used, each gyro can be indexed or rotated about its spin axis. For example, as schematically illustrated by FIG. 5, the first gyroscopic sensor 12 is indexed or rotated by the indexing mechanism 40 about the xy-gyro spin axis (which is substantially parallel to the portion of the wellbore 20 in which the survey system 10 is positioned) and the second gyroscopic sensor 14 is indexed or rotated by the indexing mechanism 40 about the z-gyro spin axis (which is substantially perpendicular to the portion of the wellbore 20 in which the survey system 10 is positioned). However, the xy-gyro mounted on the inner gimbal 48 will also be rotated about one of its input axis during the course of the indexing. This configuration is not desirable in certain embodiments in which a dual-axis tuned rotor/dynamically tuned gyro is used. Gyros of this type are susceptible to the disturbance caused by the relatively fast slewing rotations of the gyro about an input axis, to which the gyro would be subjected during indexing, and they take a significant amount of time to recover from the transient measurement offset that is induced as a result of such slewing motion.

Figure 6:
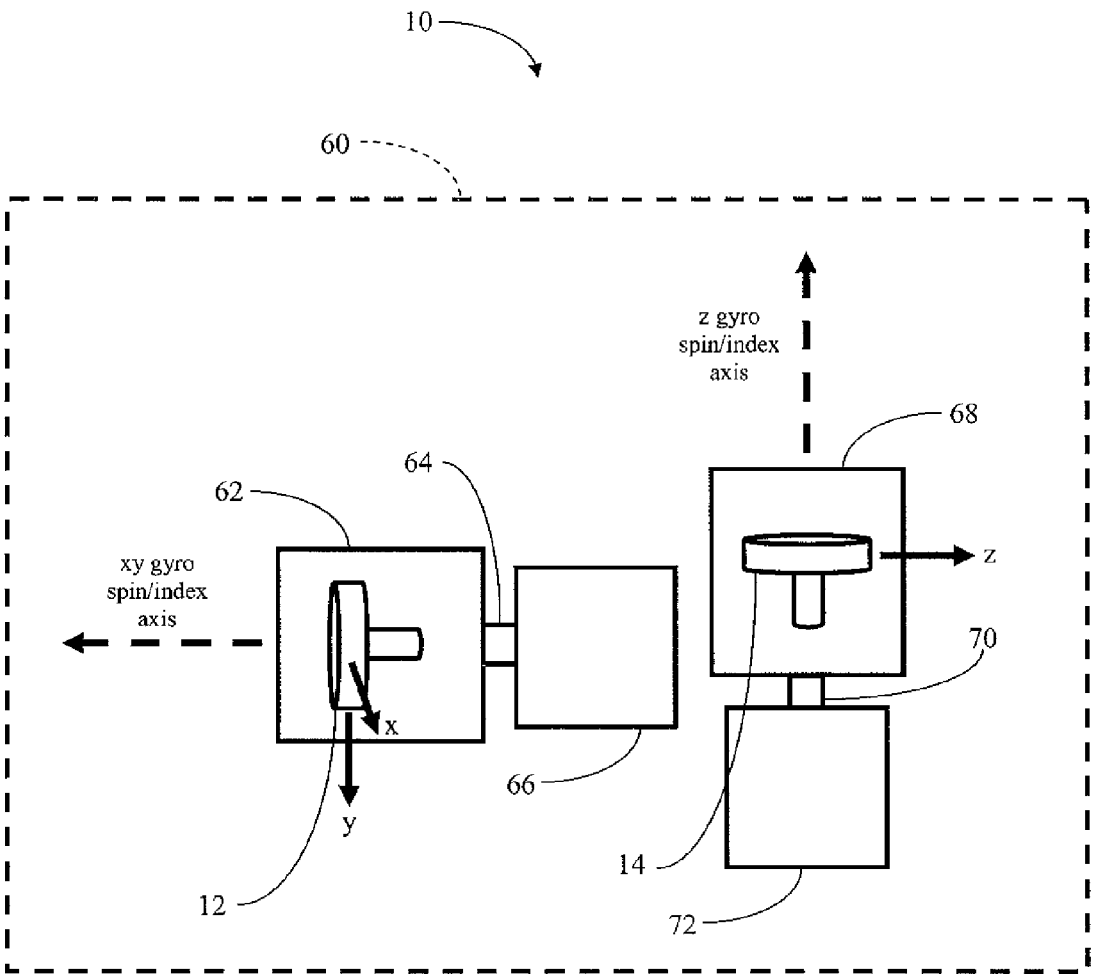
FIG. 6 schematically illustrates an example configuration of the survey system utilizing two single-axis gimbals in accordance with certain embodiments described herein.

FIG. 6 schematically illustrates an example configuration of the survey system 10 utilizing single-axis gimbals in accordance with certain embodiments described herein. The survey system 10 of FIG. 6 comprises an alternative indexing mechanism 60 comprising a first single-axis gimbal 62, a first drive shaft 64, and a first drive motor 66 which rotates or indexes the first gyroscopic sensor 12 via the first drive shaft 64. The indexing mechanism 60 further comprises a second single-axis gimbal 68, a second drive shaft 70, and a second drive motor 72 which rotates or indexes the second gyroscopic sensor 14 via the second drive shaft 70. The indexing mechanism 60 of FIG. 6 is useful if dynamically tuned gyros are chosen. The two gyros may be indexed independently by the first drive motor 66 and the second drive motor 72.

Figure 7:
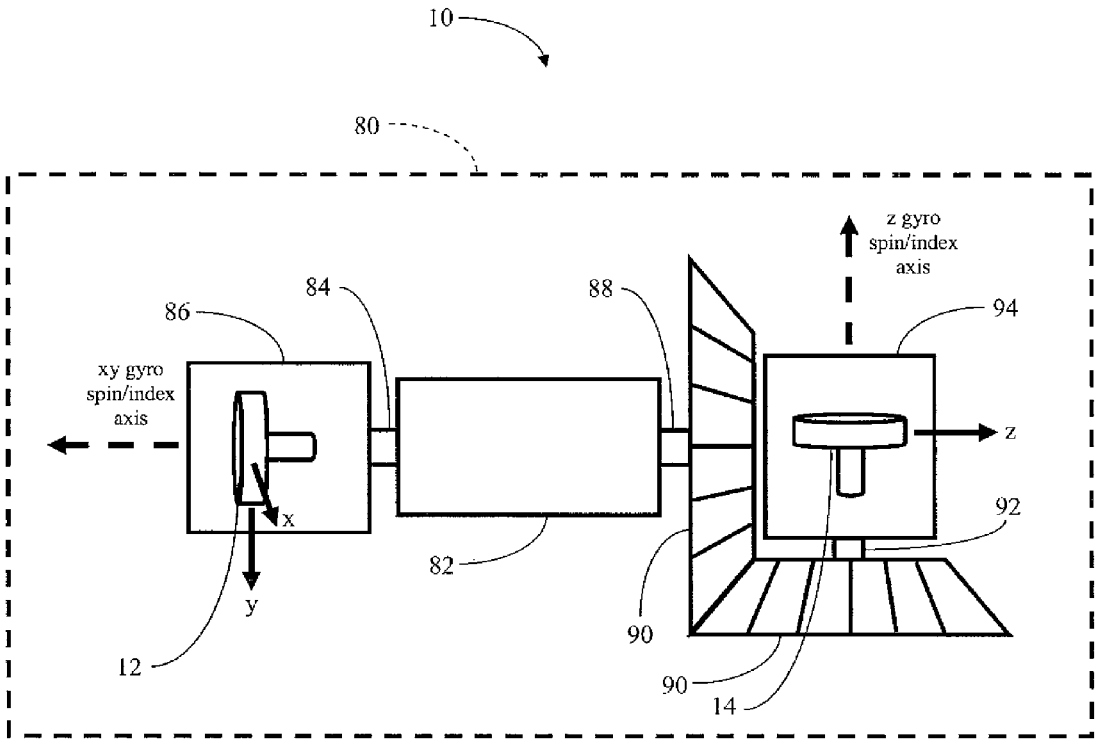
FIG. 7 schematically illustrates an example configuration of the survey system utilizing a bevel gear train and a single drive motor in accordance with certain embodiments described herein.

FIG. 7 schematically illustrates an example configuration of the survey system 10 utilizing a bevel gear train and a single drive motor in accordance with certain embodiments described herein. The indexing mechanism 80 comprises a drive motor 82, a first drive shaft 84, a first single-axis gimbal 86, a second drive shaft 88, a beveled gear train having a pair of bevel gears 90, a third drive shaft 92, and a second single-axis gimbal 94. In certain embodiments, the first drive shaft 84 and the second drive shaft 88 are portions of the same shaft. The single drive motor 82 is configured to rotate both gyros as illustrated in FIG. 7. The single drive motor configuration of FIG. 7 can be used in a reduced tool diameter configuration, as compared to the two motor scheme of FIG. 6. In the single motor system of FIG. 7, the xy-gyro is driven directly, while the z-gyro is driven via the two bevel gears 90 of the beveled gear train, thereby transferring rotational motion from the second drive shaft 88 to the third drive shaft 92 which is substantially perpendicular to the second drive shaft 88. In certain embodiments utilizing this configuration, each gyro will only be rotated about its spin axis for the purposes of indexing and the transient disturbances that may otherwise occur are advantageously minimized. The indexing mechanism 80 schematically illustrated in FIG. 7 advantageously achieves indexed rotations of the first gyroscopic sensor 12 and the second gyroscopic sensor 14 deployed in the wellbore survey system 10 to provide measurements of angular rate about axes that are mutually orthogonal. The survey system 10 as shown in FIG. 7 makes use of a single drive motor to achieve indexed rotations of both gyros, the two axes of rotation being perpendicular to one another. While FIG. 7 shows the drive motor 82 between the first gyroscopic sensor 12 and the second gyroscopic sensor 14, other configurations (e.g., the positions of the drive motor and the xy-gyro interchanged) are also compatible with certain embodiments described herein.

In certain embodiments, the survey system 10 and the indexing mechanism 80 are provided with sufficient stability to ensure that the orientation of the input axes of the first gyroscopic sensor 12 and the second gyroscopic sensor 14 remain fixed relative to both the casing of the survey system 10 and to one another while measurements are being made. Certain embodiments described herein ensure the smooth transition of the first gyroscopic sensor 12 and the second gyroscopic sensor 14 between their respective index positions or orientations, particularly in relation to the beveled gear train for the z-gyro. These conditions are advantageously satisfied in certain embodiments in the hostile environment to which a downhole survey system 10 may be subjected during operation, so as to advantageously minimize the impact of high levels of mechanical shock, vibration, and temperature variation on the survey system 10.

Returning to FIG. 3, the method 100 further comprises generating a first measurement signal indicative of the at least one component of the Earth's rotation substantially perpendicular to the portion of the wellbore 20 using the first gyroscopic sensor 12 while the first gyroscopic sensor 12 is in a first orientation relative to the wellbore 20 in an operational block 120. The method 100 further comprises generating a second measurement signal indicative of the at least one component of the Earth's rotation substantially perpendicular to the portion of the wellbore 20 using the first gyroscopic sensor 12 while the first gyroscopic sensor 12 is in a second orientation relative to the wellbore 20 different from the first orientation in an operational block 130.

In certain embodiments, the first gyroscopic sensor 12 comprises a gyroscope configured to generate signals indicative of at least two components of the Earth's rotation substantially perpendicular to the portion of the wellbore 20 in which the survey system 10 is positioned. In certain other embodiments, the first gyroscopic sensor 12 comprises at least a first gyroscope configured to generate signals indicative of a first component of the Earth's rotation substantially perpendicular to the portion of the wellbore 20 and at least a second gyroscope configured to generate signals indicative of a second component of the Earth's rotation substantially perpendicular to the portion of the wellbore 20 and substantially perpendicular to the first component.

In certain embodiments, the first gyroscopic sensor 12 adapted to be indexed or rotated from its first orientation to its second orientation (e.g., using the indexing mechanism of the survey system 10) between generating the first measurement signal and the second measurement signal. In certain embodiments, indexing the first gyroscopic sensor 12 comprises rotating the first gyroscopic sensor 12 about a direction substantially parallel to the portion of the wellbore 20 from a first orientation to a second orientation different from the first orientation. In certain embodiments, the second orientation of the first gyroscopic sensor 12 is different from the first orientation of the first gyroscopic sensor 12 by about 180 degrees, thereby allowing the effects of residual measurement biases to be effectively removed by calculating the difference between measurements taken at each index orientation. However, in certain other embodiments, an index rotation angle of less than 180 degrees can be used since this configuration still allows bias corrections to be made. For example, a number (e.g., four) of measurements may be taken with the first gyroscopic sensor 12 at two or more index positions differing from one another by 90 degrees (e.g., the difference between the first orientation and the second orientation can be 90 degrees, and additional measurements can be made with the first gyroscopic sensor 12 at a third orientation which is 90 degrees from the second orientation and at a fourth orientation which is 90 degrees from the third orientation). Other rotational angles may be used during the indexing process, provided that the magnitude of the rotations are known or can be determined accurately as a result of a pre-run calibration procedure.

In certain embodiments, the first measurement signal comprises a plurality of measurement signals generated while the first gyroscopic sensor 12 is in a first orientation and which can, for example, be averaged together. In certain embodiments, the second measurement signal comprises a plurality of measurement signals generated while the first gyroscopic sensor 12 is in a second orientation and which can, for example, be averaged together.

The method 100 further comprises generating a third measurement signal indicative of the component of the Earth's rotation substantially parallel to the portion of the wellbore 20 using the second gyroscopic sensor 14 while the second gyroscopic sensor 14 is in a first orientation relative to the wellbore 20 in an operational block 140. The method 100 further comprises generating a fourth measurement signal indicative of the component of the Earth's rotation substantially parallel to the portion of the wellbore 20 using the second gyroscopic sensor 14 while the second gyroscopic sensor 14 is in a second orientation relative to the wellbore 20 different from the first orientation in an operational block 150.

In certain embodiments, the second gyroscopic sensor 14 adapted to be indexed or rotated from its first orientation to its second orientation (e.g., using the indexing mechanism of the survey system 10) between generating the third measurement signal and the fourth measurement signal. In certain embodiments, indexing the second gyroscopic sensor 14 comprises rotating the second gyroscopic sensor 14 about a direction substantially perpendicular to the portion of the wellbore 20 from a first orientation to a second orientation different from the first orientation. In certain embodiments, the second orientation of the second gyroscopic sensor 14 is different from the first orientation of the second gyroscopic sensor 14 by about 180 degrees, thereby allowing the effects of residual measurement biases to be effectively removed by calculating the difference between measurements taken at each index orientation. However, in certain other embodiments, an index rotation angle of less than 180 degrees can be used since this configuration still allows bias corrections to be made. For example, a number (e.g., four) of measurements may be taken with the second gyroscopic sensor 14 at two or more index positions differing from one another by 90 degrees (e.g., the difference between the first orientation and the second orientation can be 90 degrees, and additional measurements can be made with the second gyroscopic sensor 14 at a third orientation which is 90 degrees from the second orientation and at a fourth orientation which is 90 degrees from the third orientation). Other rotational angles may be used during the indexing process, provided that the magnitude of the rotations are known or can be determined accurately as a result of a pre-run calibration procedure. In certain embodiments, indexing the second gyroscopic sensor 14 occurs simultaneously with indexing the first gyroscopic sensor 12.

In certain embodiments, the third measurement signal comprises a plurality of measurement signals generated while the second gyroscopic sensor 14 is in a first orientation and which can, for example, be averaged together. In certain embodiments, the fourth measurement signal comprises a plurality of measurement signals generated while the second gyroscopic sensor 14 is in a second orientation and which can, for example, be averaged together.

The method 100 further comprises calculating information regarding at least one error contribution to measurement signals from the survey system 10 using the first measurement signal, the second measurement signal, the third measurement signal, and the fourth measurement signal in an operational block 160. The at least one error contribution comprises at least one of a mass unbalance offset error and a quadrature bias error of at least one of the first gyroscopic sensor 12 and the second gyroscopic sensor 14. In certain embodiments, the method 100 further comprises calculating information regarding the orientation of the survey system 10 relative to the Earth using the information regarding at least one error contribution to the measurement signals.

Figure 8:
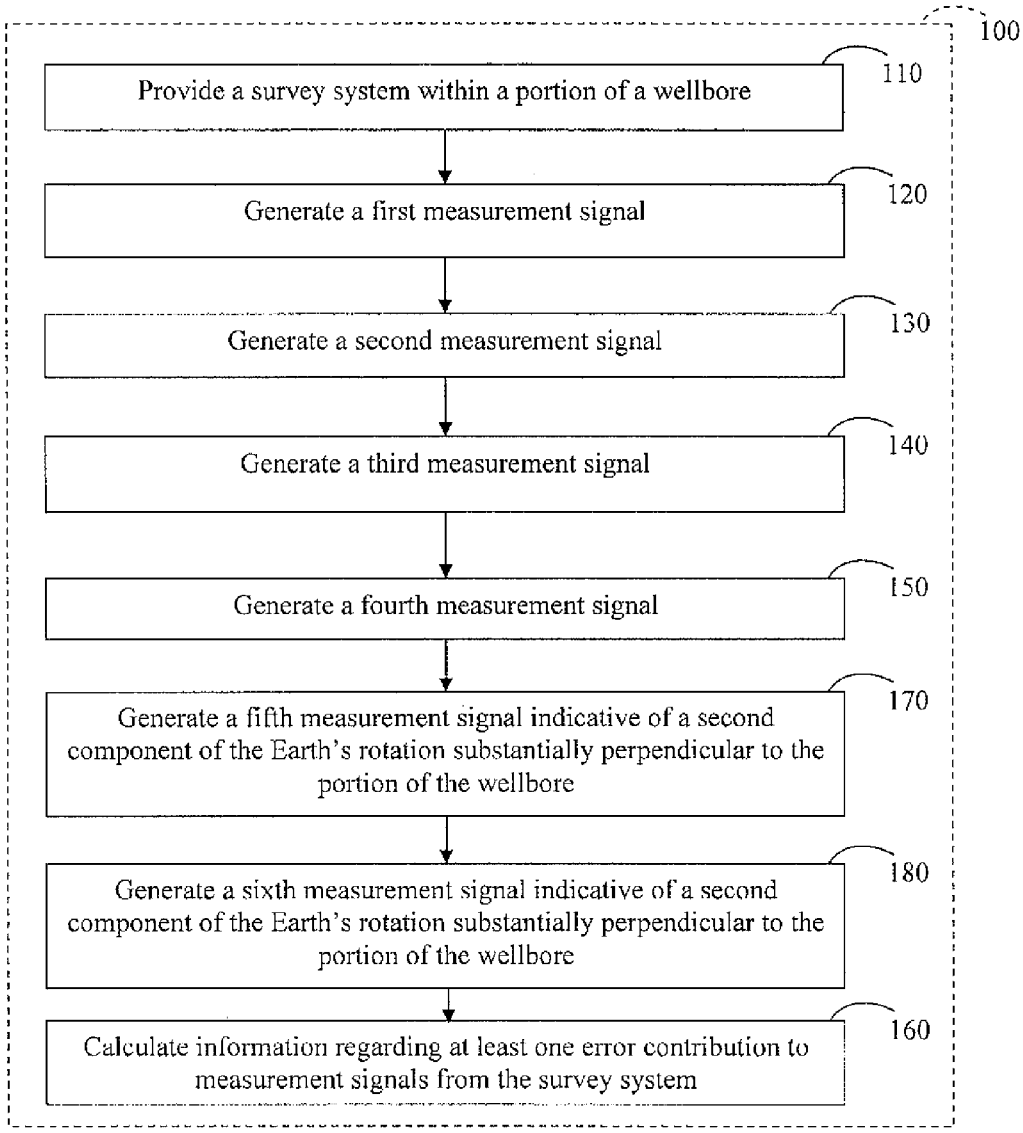
FIG. 8 is a flow diagram of another example method for reducing error contributions to gyroscopic measurements in accordance with certain embodiments described herein.

FIG. 8 is a flow diagram of an example method 100 for reducing error contributions to gyroscopic measurements in accordance with certain embodiments described herein. In certain embodiments, the method 100 further comprises generating a fifth signal indicative of a second component of the Earth's rotation substantially perpendicular to the portion of the wellbore 20 using a gyroscopic sensor of the survey system 10 while the gyroscopic sensor is in a first orientation relative to the wellbore 20 in an operational block 170. In certain such embodiments, the method 100 further comprises generating a sixth signal indicative of the second component of the Earth's rotation substantially perpendicular to the portion of the wellbore 20 while the gyroscopic sensor is in a second orientation relative to the wellbore 20 in an operational block 180. In certain such embodiments, calculating information regarding at least one error contribution to measurement signals from the survey system 10 further comprises using the fifth signal and the sixth signal. In certain embodiments, the gyroscopic sensor used to generate the fifth signal and the sixth signal is the first gyroscopic sensor 12 (e.g., the first gyroscopic sensor comprises a dual-axis gyro).

System Equations

The system equations used in certain embodiments to calculate information regarding at least one error contribution to measurement signals from the survey system 10 are discussed below in conjunction with an example survey system 10. This example survey system 10 comprises a first gyroscopic sensor 12 comprising a dual-axis dynamically tuned gyro (e.g., xy-gyro) mounted to provide measurement signals regarding the components of the Earth's rotation along the lateral (x and y) axes of the survey system 10. This example survey system 10 further comprises a second gyroscopic sensor 14 comprising a dual-axis dynamically tuned gyro (e.g., xz-gyro or yz-gyro) mounted to provide measurement signals regarding the components of the Earth's rotation along the longitudinal (z) axis of the survey system 10 and along a second axis that may be co-incident with either the x-axis or the y-axis, or an intermediate axis in the xy plane. In this example survey system 10, the indexing mechanism applies index rotations to both gyros about their respective spin axes.

Figure 9:
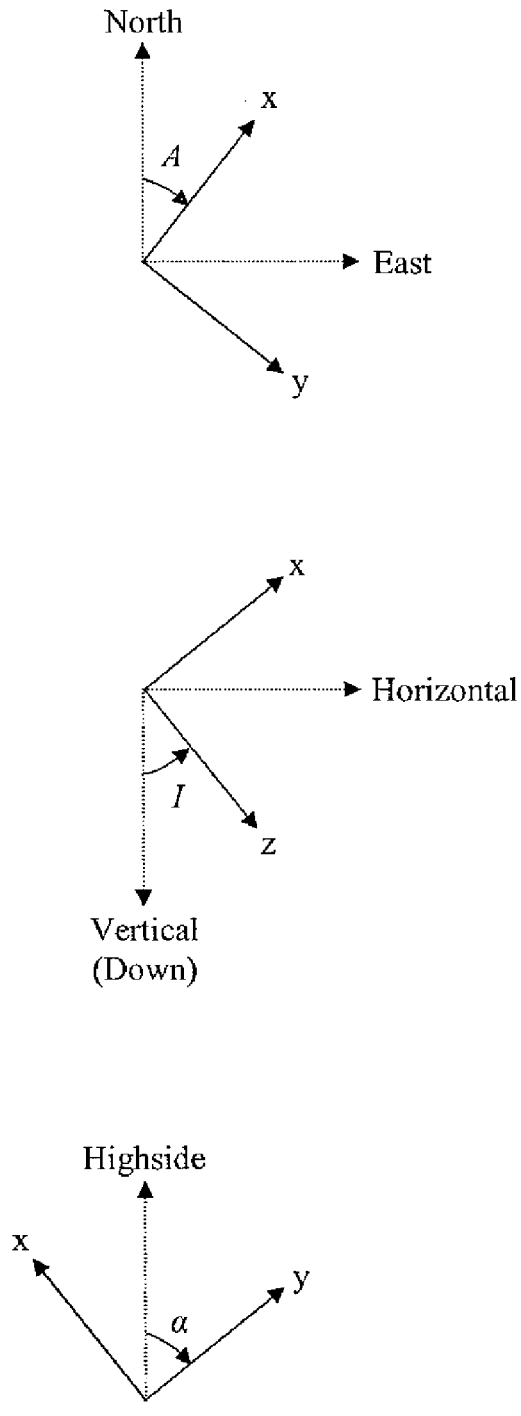
FIG. 9 schematically illustrates the azimuthal angle, the inclination angle, and the high side tool face angle for an example survey system in accordance with certain embodiments described herein.

During a stationary survey, the first gyroscopic sensor 12 and the second gyroscopic sensor 14 measure the components of Earth's rotation rate ($\Omega$), which may be expressed in local geographic axes (defined by the directions of true north, east and the local vertical) as:

$$\begin{bmatrix} \Omega_H \\ 0 \\ \Omega_V \end{bmatrix} = \begin{bmatrix} \Omega\cos\phi \\ 0 \\ -\Omega\sin\phi \end{bmatrix} \tag{1}$$

where $\Omega_H$ and $\Omega_V$ represent the horizontal and vertical components of Earth's rotation rate respectively, and $\phi$ is the latitude. The Earth's rotation rate may be expressed in survey system axes (x, y, z) as follows:

$$\begin{bmatrix} \omega_x \\ \omega_y \\ \omega_z \end{bmatrix} = \begin{bmatrix} \sin\alpha & -\cos\alpha & 0 \\ \cos\alpha & \sin\alpha & 0 \\ 0 & 0 & 1 \end{bmatrix} \begin{bmatrix} \cos I & 0 & -\sin I \\ 0 & 1 & 0 \\ \sin I & 0 & \cos I \end{bmatrix} \begin{bmatrix} \cos A & \sin A & 0 \\ -\sin A & \cos A & 0 \\ 0 & 0 & 1 \end{bmatrix} \begin{bmatrix} \Omega\cos\phi \\ 0 \\ -\Omega\sin\phi \end{bmatrix} = \begin{bmatrix} \Omega\cos\phi\cos A\cos I\sin\alpha + \Omega\sin\phi\sin I\sin\alpha + \Omega\cos\phi\sin A\cos\alpha \\ \Omega\cos\phi\cos A\cos I\cos\alpha + \Omega\sin\phi\sin I\cos\alpha - \Omega\cos\phi\sin A\sin\alpha \\ \Omega\cos\phi\cos A\sin I - \Omega\sin\phi\cos I \end{bmatrix} \tag{2}$$

where A=azimuth angle, I=inclination angle, and $\alpha$=high side tool face angle as shown in FIG. 9.

The measurements of these quantities provided by the first and second gyroscopic sensors 12, 14 may be in error owing to a variety of causes, including mounting misalignments of the gyros, scale factor errors, and other imperfections within the gyroscopic sensors. These effects give rise to fixed and g-dependent bias terms in dynamically tuned gyros, including but not limited to, mass unbalance error and quadrature error. While the error terms can be identified and corrected following a pre-run calibration procedure, some of the errors are known to be unstable (e.g., biases and mass unbalance effects, particularly for rotor gyros), and the initial calibration therefore cannot be relied upon to provide adequate measurement accuracy throughout the operational use of the survey system 10.

The equations for the individual gyro measurements and the indexing process are given below.

xy-Gyro

The input axes of the xy-gyro of the first gyroscopic sensor 12 in this example are nominally coincident with the x and y axes of the survey system 10 respectively, and the spin axis of the xy-gyro is substantially parallel to the along-hole direction (z axis). The angular rotation rates applied about the sensitive axes of the xy-gyro may be expressed as:

$$\omega_x = \Omega_H(\cos A\cos I\sin\alpha + \sin A\cos\alpha) - \Omega_V\sin I\sin\alpha$$

$$\omega_y = \Omega_H(\cos A\cos I\cos\alpha - \sin A\sin\alpha) - \Omega_V\sin/\cos\alpha \tag{3}$$

In the presence of sensor bias instability, the xy-gyro measurements may be expressed in terms of the applied rates ($\omega_x$, $\omega_y$) and the measurement biases ($B_x$, $B_y$) as follows:

$$\omega_{x0} = \omega_x + B_x$$

$$\omega_{y0} = \omega_y B_y \tag{4}$$

The measurements will also include random bias terms, the effects of which may be substantially reduced by averaging a number of measurements sampled at high speed. Such effects are therefore ignored for the purposes of this example discussion.

Upon being indexed by being rotated by 180°, the gyro measurements become:

$$\omega_{x1} = -\omega_x + B_x$$

$$\omega_{y1} = -\omega_y + B_y \tag{5}$$

The fixed biases in the measurements may be determined by using the following calculations:

$$B_x(\omega_{x0} + \omega_{x1})/2$$

$$B_y = (\omega_{y0} + \omega_{y1})/2 \tag{6}$$

and estimates of the input rotation rates ($\hat{\omega}_x$ and $\hat{\omega}_y$) can be made by calculating the difference between the two index measurements for each input axis to remove the effect of measurement biases as follows:

$$\hat{\omega}_x = (\omega_{x0} - \omega_{x1})/2$$

$$\hat{\omega}_y = (\omega_{y0} - \omega_{y1})/2 \tag{7}$$

While this calculation removes residual biases from the measured rotation rates, it does not take account of measurement errors that may be present as a result of residual mass unbalance and quadrature errors. These effects are addressed separately below.

z-gyro

For the purposes of this example, it is assumed that one input axis (u) of the second gyroscopic sensor 14 is nominally coincident with the z-axis of the survey system 10. The second input axis (v) and the spin axis (w) of the second gyroscopic sensor 14 are assumed to lie in the xy plane rotated through an angle $\lambda$ about the z-axis with respect to the x and y axes respectively, where $\lambda$ is defined as the gyro skew angle.

The angular rates applied about the sensitive (u and v) axes of the z-gyro of the second gyroscopic sensor 14 may therefore be expressed as follows:

$$\omega_u=\omega_z$$

$$\omega_v=\omega_y \cos\lambda-\omega_x \sin\lambda \tag{8}$$

or as a function of Earth's rate and survey tool orientation as:

$$\omega_u=\Omega_H \cos A \sin I+\Omega_V \cos I$$

$$\omega_v=\Omega_H\{\cos A \cos I \cos(\alpha-\lambda)-\sin A \sin(\alpha-\lambda)\}-\omega_V \sin I \cos(\alpha-\lambda) \tag{9}$$

Estimates of the z-gyro input rotation rates, denoted $\hat{\omega}_u$ and $\hat{\omega}_v$, can be formed from the measurements taken at indexed positions in a manner similar to that described above for the xy-gyro measurements.

Having applied indexing corrections to the x, y, and u (z) gyroscopic measurements taken at each survey station, azimuth estimates can be generated at each station using the following equation:

$$\tan A = \frac{(\hat{\omega}_x \cos\alpha - \hat{\omega}_y \sin\alpha)}{(\hat{\omega}_x \sin\alpha + \hat{\omega}_y \cos\alpha)\cos I + \hat{\omega}_u \sin I} \tag{10}$$

The inclination angle and tool face angle values used in equation (10) are derived from accelerometer measurements taken at each survey station.

In certain embodiments, the redundant rate measurement ($\hat{\omega}_v$) from the second gyroscopic sensor 14 provides a check on the performance of the first gyroscopic sensor 12 (e.g., the xy-gyro), and can be used as an additional measure for quality control purposes. Redundant measurements can also be used directly in the azimuth calculation (as described below) in certain embodiments in which statistical calculation methods such as a least squares adjustment are used.

Mass Unbalance and Quadrature Errors

As described above, the xy-gyro measurements may be expressed in terms of the applied rates ($\omega_x$, $\omega_y$), measurement biases ($B_x$,$B_y$) using equation (4). If the gyro index angle is θ, the gyro measurements become:

$$\omega_{x1}=\omega_x \cos\theta+\omega_y \sin\theta+B_x$$

$$\omega_{y1}=-\omega_x \sin\theta+\omega_y \cos\theta+B_y \tag{11}$$

Estimates of the input rotation rates ($\hat{\omega}_x$ and $\hat{\omega}_y$) can be made by first calculating the difference between the index measurements for each channel to remove the effect of measurement biases. Given knowledge of the index angle θ, the applied rotation rates may then be calculated using the following equations:

$$\hat{\omega}_x = \frac{(\omega_{x0}-\omega_{x1})}{2} + \frac{(\omega_{y0}-\omega_{y1})}{2}\cdot\frac{\sin\theta}{(1-\cos\theta)} \tag{12}$$

$$\hat{\omega}_y = \frac{(\omega_{y0}-\omega_{y1})}{2} - \frac{(\omega_{x0}-\omega_{x1})}{2}\cdot\frac{\sin\theta}{(1-\cos\theta)}$$

The indexing procedure described thus far may be extended to facilitate the estimation and correction of additional errors in the gyro measurements. For example, in certain embodiments, four index locations at 90 degree intervals may be selected. In certain such embodiments, the xy-gyro measurements may be expressed in terms of the applied rates, measurement biases ($B_x$, $B_y$), a mass unbalance offset ($M_{xy}$) and a quadrature g-dependent bias ($Q_{xy}$) as follows:

$$\omega_{x0}=\omega_x+B_x+M_{xy}\cdot a_x+Q_{xy}\cdot a_y$$

$$\omega_{y0}=\omega_y+B_y+M_{xy}\cdot a_y+Q_{xy}\cdot a_x \tag{13}$$

Indexed by 90°, the gyro measurements become:

$$\omega_{x2}=\omega_y+B_x+M_{xy}\cdot a_y-Q_{xy}\cdot a_x$$

$$\omega_{y2}=\omega_x+B_y+M_{xy}\cdot a_x+Q_{xy}\cdot a_y \tag{14}$$

Indexed by 180°, the gyro measurements become:

$$\omega_{x1}=\omega_x+B_x+M_{xy}\cdot a_x-Q_{xy}\cdot a_y$$

$$\omega_{y1}=\omega_y+B_y-M_{xy}\cdot a_y+Q_{xy}\cdot a_x \tag{15}$$

Indexed by 270°, the gyro measurements become:

$$\omega_{x3}=\omega_y+B_x-M_{xy}\cdot a_y+Q_{xy}\cdot a_x$$

$$\omega_{y3}=\omega_x+B_y+M_{xy}\cdot a_x+Q_{xy}\cdot a_y \tag{16}$$

In certain embodiments, estimates of the biases ($\hat{B}_x$, $\hat{B}_y$) can be made by calculating the sum of measurements taken at index positions that are 180 degrees apart, for example:

$$\hat{B}_x=(\omega_{x0}+\omega_{x1})/2$$

$$\hat{B}_y=(\omega_{y0}+\omega_{y1})/2 \tag{17}$$

Following removal of the estimated biases from the measurements, estimates of the quadrature bias ($\hat{Q}_{xy}$) can be obtained in certain embodiments by calculating the sum or difference between measurements taken at index positions that are 90 degrees apart, for example:

$$\hat{Q}_{xy} = (\omega_{x0}+\omega_{y2})/2a_y = (\omega_{x3}-\omega_{y1})/2a_x \tag{18}$$

Similar calculations can be performed using the indexed z-gyro measurements in order to obtain estimates of the biases ($B_u$, $B_y$) and quadrature error ($Q_{uv}$) associated with the z-gyro.

In certain embodiments, estimates of the mass unbalance offset for each gyro of the first gyroscopic sensor 12 and the second gyroscopic sensor 14 can be determined using the following procedure. Upon removal of the effects of biases and quadrature errors, the following measurement equations remain for a system containing two dual-axis gyros (e.g., two dynamically tuned gyros):

$$\omega_{x0}=\omega_x+M_{xy}\cdot a_x$$

$$\omega_{y0}=\omega_y+M_{xy}\cdot a_y$$

$$\omega_{u0}=\omega_u+M_{uv}\cdot a_u$$

$$\omega_{v0}=\omega_v+M_{uv}\cdot a_v \tag{19}$$

The measurement equations can be expressed in terms of Earth's rotation rate and the orientation of the survey system 10 (azimuth angle, inclination angle, and tool face angle):

$$\omega_{x0}=\Omega_H(\cos A \cos I \sin\alpha+\sin A \cos\alpha)-\Omega_V \sin I \sin\alpha-M_{xy} \sin I \sin\alpha$$

$$\omega_{y0}=\Omega_H(\cos A \cos I \sin\alpha-\sin A \cos\alpha)-\Omega_V \sin I \cos\alpha-M_{xy} \sin I \cos\alpha \tag{20}$$

$$\omega_{u0}=\Omega_H \cos A \sin I+\Omega_V \cos I+M_{uv} \cos I$$

$$\omega_v=\Omega_H\{\cos A \cos I \cos(\alpha-\lambda)-\sin A \sin(\alpha-\lambda)\}-\Omega_V \sin I \cos(\alpha-\lambda)+M_{uv} \sin I \cos(\alpha-\lambda)$$

The survey system 10 will typically incorporate a triad of accelerometers in addition to the gyros of the first gyroscopic sensor 12 and the second gyroscopic sensor 14. The sensitive axes of these accelerometers in certain embodiments are coincident with the x, y and z axes of the survey system 10. In certain such embodiments, measurements from the accelerometers are used to determine the inclination angle (I) and the tool face angle (α) of the survey system 10 at each survey location or survey station within the wellbore 20. Further, in certain embodiments, the uv-gyro mounting angle (λ) is known. In certain such embodiments, four equations remain with three unknowns; A, $M_{xy}$, and $M_{uv}$. The values of these quantities can be determined in certain embodiments using a least squares calculation or other statistical filtering method.

Figure 10A:
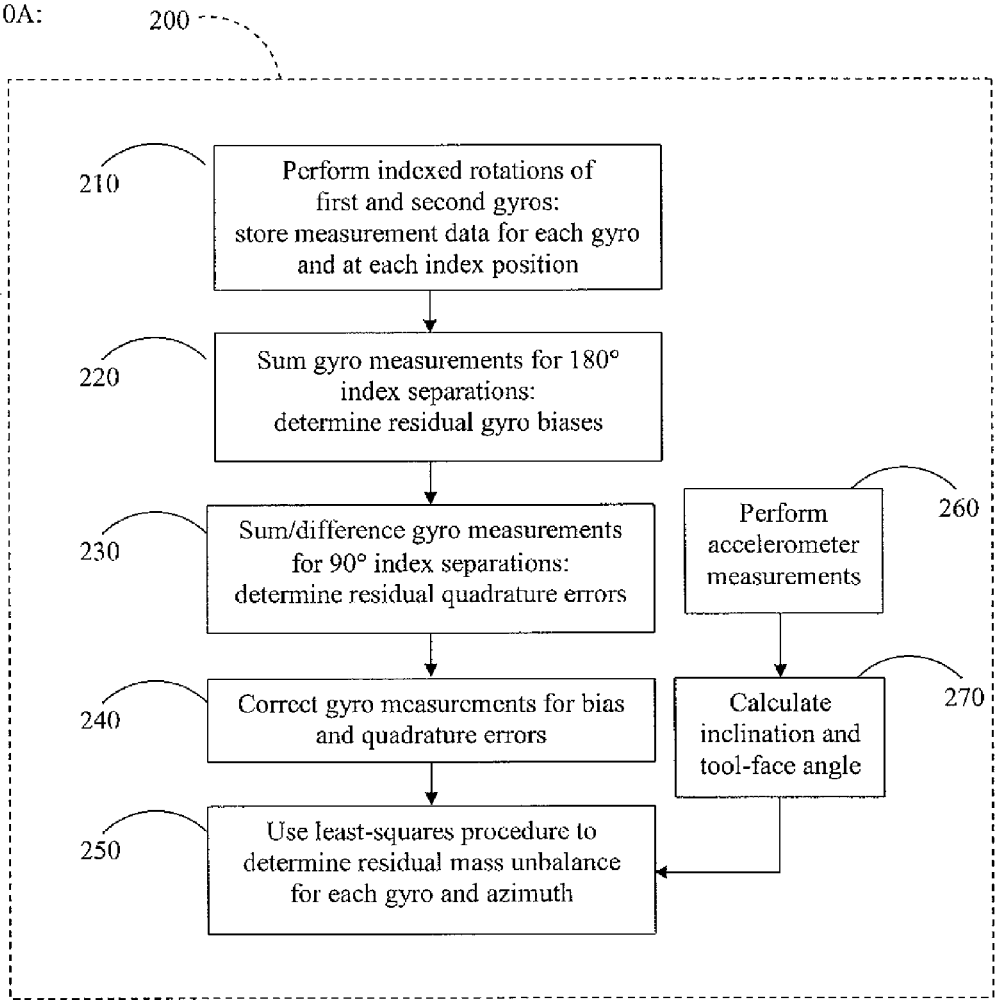
FIGS. 10A and 10B are two flow diagrams of example methods in accordance with certain embodiments described herein which advantageously allow an accurate directional survey to be obtained at any wellbore inclination using a gyro survey system within a relatively short period of time.
Figure 10B:
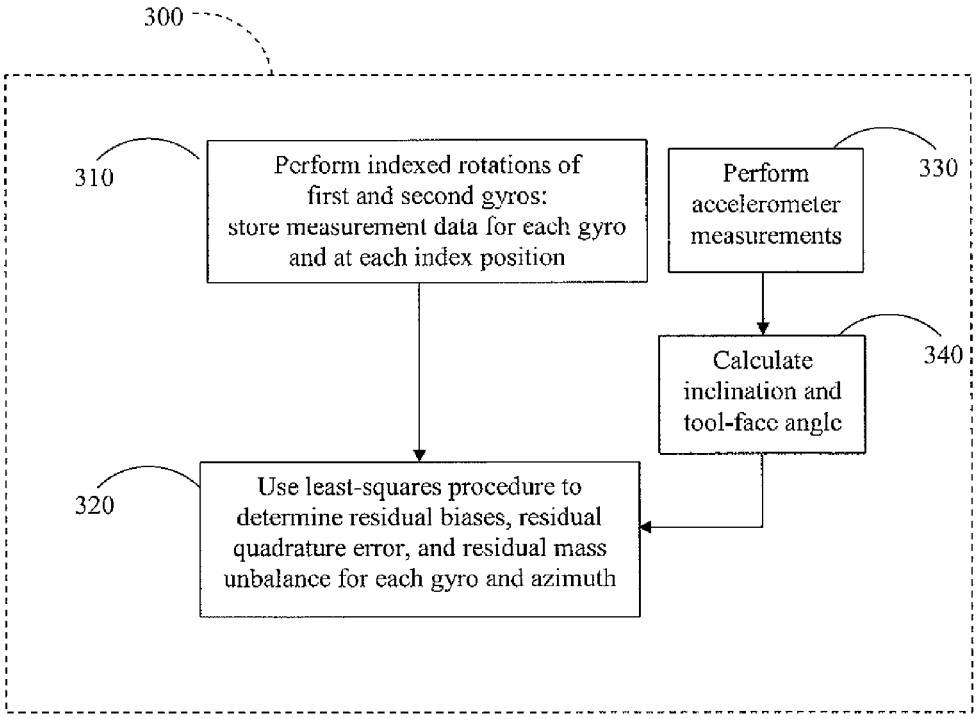
Figure 11:
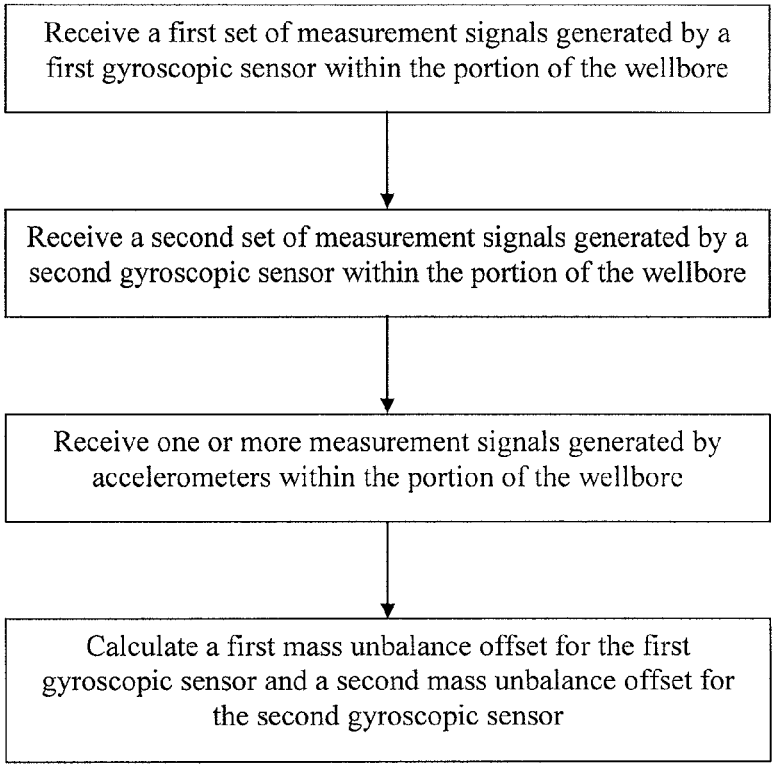
FIG. 11 is a flow diagram of an example method in accordance with certain embodiments described herein.

FIGS. 10A and 10B are two flow diagrams of two example methods 200, 300 in accordance with certain embodiments described herein which advantageously allow an accurate directional survey to be obtained at any wellbore inclination using a gyro survey system 10 within a relatively short period of time. For example, in certain embodiments, an accurate directional survey is obtained within less than a minute. The time for providing the survey information is dependent on the time used to collect and average measurements in each index position, and the computing time is negligible. The duration of the survey process in certain embodiments is compatible with the exacting operational demands placed upon downhole survey systems.

In certain embodiments, a four-position index procedure is performed for each of the first gyroscopic sensor 12 and the second gyroscopic sensor 14 (e.g., the xy-gyro and the z-gyro) in which measurements are taken at an initial orientation, and at 90, 180 and 270 degree angles with respect to the initial orientation. These example methods 200, 300 include implementing a set of calculations following the extraction of the measurement data, thereby allowing estimates of the gyro biases, mass unbalance, and quadrature g-dependent errors to be calculated. Thus, in certain embodiments, variations that may well arise in the magnitude of these gyro error terms between the calibration of a survey system 10 and its subsequent operational use in the field may be removed, thus facilitating a more accurate gyro compassing survey than could otherwise be achieved.

In an operational block 210, the example method 200 shown in FIG. 10A comprises performing indexed rotations of the first gyroscopic sensor 12 and the second gyroscopic sensor 14 and storing the measurement data obtained from each gyroscopic sensor and at each index position in memory. In certain embodiments, the indexing measurements are taken at a number of pre-defined and accurately known angles (e.g., at an initial orientation defined to be zero degrees, at 90 degrees, at 180 degrees, and at 270 degrees). In certain embodiments, both gyroscopic sensors (e.g., both the xy-gyro and the z-gyro) are indexed or rotated simultaneously, while in certain other embodiments, the gyroscopic sensors are indexed or rotated non-concurrently with one another.

In an operational block 220, the sums of measurements taken with 180 degrees index separation are calculated for each gyroscopic sensor to determine the residual gyro biases for each gyroscopic sensor as described above. In an operational block 230, the sums and the differences of measurements taken with 90 degrees separation are calculated for each gyroscopic sensor to determine the residual quadrature errors for each gyroscopic sensor as described above. In an operational block 240, the residual gyro biases and the residual quadrature errors are used to correct measurements from the gyroscopic sensors by calculating corrected values for the measurements with these effects removed or subtracted out.

In an operational block 250, a least-squares adjustment or statistical filtering process is used to calculate the residual mass unbalance for each of the first gyroscopic sensor 12 and the second gyroscopic sensor 14. In certain such embodiments, accelerometer measurements are performed in an operational block 260 and these measurements are used to calculate inclination and tool-face angle in an operational block 270. The calculated inclination and tool-face angle can then be used in the least-squares adjustment or statistical filtering process to determine the system errors for each gyroscopic sensor and azimuth.

In an operational block 310, the example method 300 shown in FIG. 10B comprises performing indexed rotations of the first gyroscopic sensor 12 and the second gyroscopic sensor 14 and storing the measurement data obtained from each gyroscopic sensor and at each index position in memory. In an operational block 320, a full least-squares adjustment or statistical filtering process is used to calculate all system errors, including gyro biases, mass unbalance, and quadrature errors via a single set of calculations based on the indexed measurements taken with each of the first gyroscopic sensor 12 and the second gyroscopic sensor 14. In certain such embodiments, accelerometer measurements are performed in an operational block 330 and these measurements are used to calculate inclination and tool-face angle in an operational block 340. The calculated inclination and tool-face angle can then be used in the full least-squares adjustment or statistical filtering process to determine the system errors for each gyroscopic sensor and azimuth.

Statistical Filter/Estimation Process

In certain embodiments, a statistical filter for the calculation of the residual bias, quadrature error, and/or mass unbalance contributions may be constructed based on a mathematical model of the system which yields estimates of the gyro errors and tool azimuth direction at each survey station. In the example embodiment outlined below, the filter is used to obtain estimates of any residual measurement biases and the mass unbalance offset associated with each gyroscopic sensor. In certain embodiments, the states of the system may be written as follows:

$$x=[A_k B_x B_y M_{xy} B_u B_v M_{uv}]^T \tag{21}$$

where $A_k$ is the azimuth angle at survey station k; $B_y$ is the x axis measurement bias of the xy-gyro; $B_y$ is the y axis measurement bias of the xy-gyro; $M_{xy}$ is the mass unbalance for the xy-gyro; $B_u$ is the u axis measurement bias of the z-gyro; $B_y$ is the v axis measurement bias of the z-gyro; and $M_{uv}$ is the mass unbalance for the z-gyro. $A_k$ is a station-dependent state while the sensor errors are independent of tool location.

The initial azimuth ($A_0$) may be determined using the initial set of indexed gyro measurements via the following equations.

$$A_0 = \arctan\left[\frac{\hat{\omega}_x \cos\hat{\tau} - \hat{\omega}_y \sin\hat{\tau}}{(\hat{\omega}_x \sin\hat{\tau} + \hat{\omega}_y \cos\hat{\tau})\cos\hat{I} + \hat{\omega}_z \sin\hat{I}}\right] \tag{22}$$

where $$\hat{\omega}_x = \frac{G_{x0} - G_{x1}}{2},\ \hat{\omega}_y = \frac{G_{y0} - G_{y1}}{2},\ \hat{\omega}_z = -\frac{(G_{u0} - G_{u1})}{2}$$

and $G_{x0}$, $G_{y0}$, $G_{x1}$, $G_{y1}$ and $G_{u0}$, $G_{u1}$ are the respective xy and z-gyro measurements for the two indexed measurement positions, denoted by the subscripts 0 and 1.

Tool face angle and inclination are computed using the accelerometer measurements as follows:

$$\hat{\tau} = \arctan\left[\frac{-a_x}{-a_y}\right] \tag{23}$$

$$\hat{l} = \arctan\left[\frac{\sqrt{a_x^2 + a_y^2}}{a_z}\right]$$

The uncertainty in state estimates can be expressed in certain embodiments in terms of a covariance matrix at station k, denoted $P_k$. An initial value in certain embodiments is assigned to the diagonal elements of $P_k$, the variances of the error estimates. The azimuth variance of certain embodiments is set in accordance with the expected accuracy of the initial gyrocompass survey. In certain embodiments, initial values are assigned to gyro bias and mass unbalance variances in accordance with the expected variation in these parameter values following office calibration (e.g., calibration before the system is placed within the wellbore). The covariance matrix of the predicted state vector is denoted by the symbol Q.

Measurements of turn rate are provided by the gyro(s) at consecutive stationary survey locations. The gyro measurements obtained at survey station k may be expressed as:

$$\tilde{z}_k=[\tilde{G}_{x0,k}\tilde{G}_{x1,k}\tilde{G}_{y0,k}\tilde{G}_{y1,k}\tilde{G}_{u0,k}\tilde{G}_{u1,k}\tilde{G}_{v0,k}\tilde{G}_{v1,k}]^T \tag{24}$$

where $\tilde{G}_{ij,k}$ is the i-axis measurement at index position j, for survey station k. Gyro index position 1 (j=1) is displaced 180° with respect to gyro index position 0 (j=0).

Estimates of the gyro measurements for survey station k in certain embodiments are written as:

$$z_k=[G_{x0,k}G_{x1,k}G_{y0,k}G_{y1,k}G_{u0,k}G_{u1,k}G_{v0,k}G_{v1,k}]^T \tag{25}$$

where the individual measurement estimates may be expressed in terms of the states of the model.

In certain embodiments, the differences between the gyro measurements and the estimates of these quantities, denoted $\Delta z_k$, form the inputs to a Kalman filter, where $$\Delta z_k=\tilde{z}_k-z_k=[\Delta G_{x0,k}\Delta G_{x1,k}\Delta G_{y0,k}\Delta G_{y1,k}\Delta G_{u0,k}\Delta G_{u1,k}\Delta G_{v0,k}\Delta G_{v1,k}]^T \tag{26}$$

The measurement differences may be expressed in terms of the system error states, $$\Delta x_k=[\Delta A_k\Delta B_x\Delta B_y\Delta M_{xy}\Delta B_u\Delta B_v\Delta M_{uv}]T \tag{27}$$

via the following linear matrix equation:

$$\Delta z_k=H_k\cdot\Delta x_k+v_k \tag{28}$$

where $H_k$ is a 8×7 matrix, in which the elements correspond to the partial derivatives of the theoretical measurement equations and $v_k$ represents the noise on the gyro measurements.

The covariance of the measurement noise process at station k is denoted by the symbol $R_k$.

The covariance matrix corresponding to the uncertainty in the predicted state vector in certain embodiments is given by:

$$P_{k/k-1}=P_{k-1/k-1}+Q \tag{29}$$

where $P_{k/k-1}$ is the covariance matrix at station k predicted at station k−1, e.g., the covariance matrix prior to the update using the inclination measurements at station k. In certain embodiments, the system states are corrected following each measurement update, so the best estimate of the state error following each measurement update is zero. Therefore, the predicted error state is also zero.

In certain embodiments, the covariance matrix and the state vector are updated, following a measurement at station k, using the following equations:

$$P_{k/k}=P_{k/k-1}-G_k\cdot H_k\cdot P_{k/k-1} \text{ and } x_{k/k}=x_{k/k-1}+G_k\cdot\Delta z_k \tag{30}$$

where $P_{k/k}$ is the covariance matrix following the measurement update at station k, $x_{k/k-1}$ is the predicted state vector, and $x_{k/k}$ is the state vector following the measurement update. The gain matrix $G_k$ is given by:

$$G_kP_{k/k-1}\cdot H_k^T[H_k\cdot P_{k/k-1}\cdot H_k^T+R_k]^{-1} \tag{31}$$

In certain embodiments, estimates of additional gyro errors may be included as part of the gyrocompassing process described herein. Examples of the additional gyro errors which can be calculated in accordance with certain embodiments described herein include, but are not limited to, scale factor errors, mounting misalignments, quadrature error, spin axis sensitivity, and acceleration squared sensitivity.

Various embodiments have been described above. Although this invention has been described with reference to these specific embodiments, the descriptions are intended to be illustrative and are not intended to be limiting. Various modifications and applications may occur to those skilled in the art without departing from the true spirit and scope of the invention as defined in the appended claims.

What is claimed is:

1. A method of reducing error contributions to gyroscopic measurements, the method comprising:

receiving a first set of measurement signals indicative of at least one component of the Earth's rotation substantially perpendicular to a portion of a wellbore, the first set of measurement signals generated by a first gyroscopic sensor within the portion of the wellbore;

receiving a second set of measurement signals indicative of a component of the Earth's rotation substantially parallel to the portion of the wellbore, the second set of measurement signals generated by a second gyroscopic sensor within the portion of the wellbore;

receiving one or more measurement signals generated by a plurality of accelerometers within the portion of the wellbore; and calculating, using one or more measurement signals from the first set of measurement signals, one or more measurement signals from the second set of measurement signals, and the one or more measurement signals from the plurality of accelerometers, a first mass unbalance offset for the first gyroscopic sensor and a second mass unbalance offset for the second gyroscopic sensor.

2. The method of claim 1, wherein the first gyroscopic sensor comprises a spinning mass gyroscope configured to generate signals indicative of at least two components of the Earth's rotation substantially perpendicular to the portion of the wellbore.

3. The method of claim 1, wherein the first gyroscopic sensor comprises at least a first spinning mass gyroscope configured to generate signals indicative of a first component of the Earth's rotation substantially perpendicular to the portion of the wellbore and at least a second spinning mass gyroscope configured to generate signals indicative of a second component of the Earth's rotation substantially perpendicular to the portion of the wellbore and substantially perpendicular to the first component.

4. The method of claim 1, wherein the second gyroscopic sensor comprises a spinning mass gyroscope configured to generate signals indicative of a component of the Earth's rotation substantially parallel to the portion of the wellbore and a component of the Earth's rotation substantially perpendicular to the portion of the wellbore.

5. The method of claim 1, wherein the second gyroscopic sensor comprises at least a first spinning mass gyroscope configured to generate signals indicative of a component of the Earth's rotation substantially parallel to the portion of the wellbore and at least a second spinning mass gyroscope configured to generate signals indicative of a component of the Earth's rotation substantially perpendicular to the portion of the wellbore.

6. The method of claim 1, further comprising calculating, using the one or more measurement signals from the plurality of accelerometers, an inclination angle and a tool face angle of a survey system comprising the first gyroscopic sensor, the second gyroscopic sensor, and the plurality of accelerometers.

7. The method of claim 1, further comprising calculating information regarding the orientation of a survey system relative to the Earth, the survey system comprising the first gyroscopic sensor, the second gyroscopic sensor, and the plurality of accelerometers.

8. The method of claim 1, wherein the first set of measurement signals is generated by the first gyroscopic sensor within the portion of the wellbore while the first gyroscopic sensor is in a corresponding first set of at least four orientations relative to the wellbore, and two or more orientations of the first set of at least four orientations are about 90 degrees different from one another.

9. The method of claim 1, wherein the second set of measurement signals is generated by the second gyroscopic sensor within the portion of the wellbore while the second gyroscopic sensor is in a corresponding second set of at least four orientations relative to the wellbore, and two or more orientations of the second set of four orientations are about 90 degrees different from one another.

10. The method of claim 1, further comprising storing at least a portion of the first set of measurement signals generated by the first gyroscopic sensor, the second set of measurement signals generated by the second gyroscopic sensor, and the one or more measurement signals generated by the plurality of accelerometers.

11. The method of claim 1, further comprising storing the first set of measurement signals generated by the first gyroscopic sensor and the second set of measurement signals generated by the second gyroscopic sensor.

12. The method of claim 1, wherein receiving the first set of measurement signals comprises generating the first set of measurement signals by indexing the first gyroscopic sensor and receiving the second set of measurement signals comprises generating the set of measurement signals by indexing the second gyroscopic sensor.

13. The method of claim 12, wherein indexing the second gyroscopic sensor occurs simultaneously with indexing the first gyroscopic sensor.

14. The method of claim 12, wherein indexing the first gyroscopic sensor comprises rotating the first gyroscopic sensor about a direction substantially parallel to the portion of the wellbore from a first orientation to a second orientation different from the first orientation.

15. The method of claim 12, wherein indexing the second gyroscopic sensor comprises rotating the second gyroscopic sensor about a direction substantially perpendicular to the portion of the wellbore from a first orientation to a second orientation different from the first orientation.

16. The method of claim 1, wherein the first set of measurement signals are generated by the first gyroscopic sensor within the portion of the wellbore while the first gyroscopic sensor is in a corresponding first set of at least four orientations relative to the wellbore, and further wherein the second set of measurement signals are generated by the second gyroscopic sensor within the portion of the wellbore while the second gyroscopic sensor is in a corresponding second set of at least four orientations relative to the wellbore.

17. The method of claim 16, further comprising:

calculating information, using one or more measurement signals of the first set of measurement signals from the first gyroscopic sensor in at least two orientations of the first set of at least four orientations, regarding a first measurement bias to measurement signals from the first gyroscopic sensor; and calculating information, using one or more measurement signals of the second set of measurement signals from the second gyroscopic sensor in at least two orientations of the second set of at least four orientations, regarding a second measurement bias to measurement signals from the second gyroscopic sensor.

18. The method of claim 1, further comprising storing information related to the first set of measurement signals and information related to the second set of measurement signals.

19. A system for reducing error contributions to gyroscopic measurements made using a survey system within a portion of a wellbore, the system comprising:

one or more processors;

a module executing in the one or more processors and configured to:

receive a first set of measurement signals indicative of at least one component of the Earth's rotation substantially perpendicular to a portion of a wellbore, the first set of measurement signals generated by a first gyroscopic sensor within the portion of the wellbore;

receive a second set of measurement signals indicative of a component of the Earth's rotation substantially parallel to the portion of the wellbore, the second set of measurement signals generated by a second gyroscopic sensor within the portion of the wellbore;

receive one or more measurement signals generated by a plurality of accelerometers within the portion of the wellbore; and calculate, using one or more measurement signals from the first set of measurement signals, one or more measurement signals from the second set of measurement signals, and the one or more measurement signals from the plurality of accelerometers, a first mass unbalance offset for the first gyroscopic sensor and a second mass unbalance offset for the second gyroscopic sensor.

20. A method of reducing error contributions to gyroscopic measurements, the method comprising:

transmitting control signals to a structure controlling an orientation of a first gyroscopic sensor relative to a portion of a wellbore, the first gyroscopic sensor adapted to generate measurement signals indicative of at least one component of the Earth's rotation substantially perpendicular to the portion of the wellbore;

transmitting control signals to a structure controlling an orientation of a second gyroscopic sensor relative to the portion of the wellbore, the second gyroscopic sensor adapted to generate measurement signals indicative of a component of the Earth's rotation substantially parallel to the portion of the wellbore;

receiving measurement signals generated by the first gyroscopic sensor while the first gyroscopic sensor has a first orientation relative to the portion of the wellbore, while the first gyroscopic sensor has a second orientation relative to the portion of the wellbore, while the first gyroscopic sensor has a third orientation relative to the portion of the wellbore, and while the first gyroscopic sensor has a fourth orientation relative to the portion of the wellbore;

receiving measurement signals generated by the second gyroscopic sensor while the second gyroscopic sensor has a fifth orientation relative to the portion of the wellbore, while the second gyroscopic sensor has a sixth orientation relative to the portion of the wellbore, while the second gyroscopic sensor has a seventh orientation relative to the portion of the wellbore, and while the second gyroscopic sensor has an eighth orientation relative to the portion of the wellbore;

receiving one or more measurement signals generated by a plurality of accelerometers within the portion of the wellbore; and using the measurement signals generated by the first gyroscopic sensor, the measurement signals generated by the second gyroscopic sensor, and the one or more measurement signals generated by the plurality of accelerometers to calculate a first mass unbalance offset for the first gyroscopic sensor and a second mass unbalance offset for the second gyroscopic sensor.

21. The method of claim 20, wherein the first gyroscopic sensor comprises a spinning mass gyroscope configured to generate signals indicative of at least two components of the Earth's rotation substantially perpendicular to the portion of the wellbore.

22. The method of claim 20, wherein the first gyroscopic sensor comprises at least a first spinning mass gyroscope configured to generate signals indicative of a first component of the Earth's rotation substantially perpendicular to the portion of the wellbore and at least a second spinning mass gyroscope configured to generate signals indicative of a second component of the Earth's rotation substantially perpendicular to the portion of the wellbore and substantially perpendicular to the first component.

23. The method of claim 20, wherein the second gyroscopic sensor comprises a spinning mass gyroscope configured to generate signals indicative of a component of the Earth's rotation substantially parallel to the portion of the wellbore and a component of the Earth's rotation substantially perpendicular to the portion of the wellbore.

24. The method of claim 20, wherein the second gyroscopic sensor comprises at least a first spinning mass gyroscope configured to generate signals indicative of a component of the Earth's rotation substantially parallel to the portion of the wellbore and at least a second spinning mass gyroscope configured to generate signals indicative of a component of the Earth's rotation substantially perpendicular to the portion of the wellbore.

25. The method of claim 20, wherein two or more orientations of the first orientation, the second orientation, the third orientation, and the fourth orientation are about 90 degrees different from one another.

26. The method of claim 20, wherein two or more orientations of the fifth orientation, the sixth orientation, the seventh orientation, and the eighth orientation are about 90 degrees different from one another.

27. The method of claim 20, further comprising storing at least a portion of the measurement signals generated by the first gyroscopic sensor, the measurement signals generated by the second gyroscopic sensor, and the one or more measurement signals generated by the plurality of accelerometers.

28. The method of claim 20, further comprising storing the measurement signals generated by the first gyroscopic sensor and the measurement signals generated by the second gyroscopic sensor.

* * * * *

UNITED STATES PATENT AND TRADEMARK OFFICE

CERTIFICATE OF CORRECTION

PATENT NO. : 8,374,793 B2
APPLICATION NO. : 13/243989
DATED : February 12, 2013
INVENTOR(S) : Ekseth et al.

It is certified that error appears in the above-identified patent and that said Letters Patent is hereby corrected as shown below:

In the Specification

In column 14 at line 23, Change "$\omega_y = \Omega_H(\cos A \cos I \cos \alpha - \sin A \sin \alpha) - \Omega_V \sin I \cos \alpha$" to -- $\omega_y = \Omega_H(\cos A \cos I \cos \alpha - \sin A \sin \alpha) - \Omega_V \sin I \cos \alpha$ --.

In column 14 at line 30, Change "$\omega_{y0} = \omega_y B_y$" to -- $\omega_{y0} = \omega_y + B_y$ --.

In column 14 at line 44, Change "$B_x(\omega_{x0} + \omega_{x1})/2$" to -- $B_x = (\omega_{x0} + \omega_{x1})/2$ --.

In column 16 at line 4, Change "$\omega_{y2} = \omega_x + B_y + M_{xy} \cdot a_x + Q_{xy} \cdot a_y$" to -- $\omega_{y2} = -\omega_x + B_y - M_{xy} \cdot a_x + Q_{xy} \cdot a_y$ --.

In column 16 at line 7, Change "$\omega_{x1} = \omega_x + B_x + M_{xy} \cdot a_x - Q_{xy} \cdot a_y$" to -- $\omega_{x1} = -\omega_x + B_x - M_{xy} \cdot a_x - Q_{xy} \cdot a_y$ --.

In column 16 at line 9, Change "$\omega_{y1} = \omega_y + B_y - M_{xy} \cdot a_y + Q_{xy} \cdot a_x$" to -- $\omega_{y1} = -\omega_y + B_y - M_{xy} \cdot a_y - Q_{xy} \cdot a_x$ --.

In column 16 at line 12, Change "$\omega_{x3} = \omega_y + B_x - M_{xy} \cdot a_y + Q_{xy} \cdot a_x$" to -- $\omega_{x3} = -\omega_y + B_x - M_{xy} \cdot a_y + Q_{xy} \cdot a_x$ --.

In column 16 at line 14, Change "$\omega_{y3} = \omega_x + B_y + M_{xy} \cdot a_x + Q_{xy} \cdot a_y$" to -- $\omega_{y3} = \omega_x + B_y + M_{xy} \cdot a_x - Q_{xy} \cdot a_y$ --.

In column 16 at line 35, Change "($B_u$, $B_y$)" to --($B_u$, $B_v$)--.

Signed and Sealed this
Twenty-fourth Day of September, 2013

Teresa Stanek Rea

Teresa Stanek Rea
*Deputy Director of the United States Patent and Trademark Office*

In column 16 at line 58, Change "$\omega_{y0}=\Omega_H(\cos A \cos I \sin \alpha - \sin A \cos \alpha) - \Omega_V \sin I \cos \alpha - M_{xy} \sin I \cos \alpha$" to -- $\omega_{y0}=\Omega_H(\cos A \cos I \cos\alpha - \sin A \sin\alpha) - \Omega_V \sin I \cos\alpha - M_{xy} \sin I \cos\alpha$ --.

In column 18 at line 43, Change "$B_y$" to --$B_x$--.

In column 18 at line 46, Change "$B_y$" to --$B_v$--.

In column 19 at line 47, Change "$\Delta x_k=[\Delta A_k \Delta B_x \Delta B_y \Delta M_{xy} \Delta B_u \Delta B_v \Delta M_{uv}]T$" to -- $\Delta x_k=\left[\Delta A_k \;\; \Delta B_x \;\; \Delta B_y \;\; \Delta M_{xy} \;\; \Delta B_u \;\; \Delta B_v \;\; \Delta M_{uv}\right]^T$ --.

In column 20 at line 12, Change "$G_k P_{k/k-1} \cdot H_k^T [H_k \cdot P_{k/k-1} \cdot H_k^T + R_k]^{-1}$" to -- $G_k = P_{k/k-1} \cdot H_k^T \left[H_k \cdot P_{k/k-1} \cdot H_k^T + R_k\right]^{-1}$ --.